US012716170B2

(12) United States Patent
Arangdad et al.

(10) Patent No.: US 12,716,170 B2
(45) Date of Patent: Aug. 25, 2026

(54) GARMENT TREATMENT AND METHOD OF APPLICATION THEREOF

(71) Applicant: Burlington Industries LLC, Greensboro, NC (US)

(72) Inventors: Kiarash Arangdad, Cary, NC (US); Jacques A. Cantin, Greenville, SC (US); Guy Connors Lucas, Charlotte, NC (US); William J. DiIanni, Kernersville, NC (US)

(73) Assignee: Burlington Industries LLC, Charlotte, NC (US)

( * ) Notice: Subject to any disclaimer, the term of this patent is extended or adjusted under 35 U.S.C. 154(b) by 161 days.

(21) Appl. No.: 18/240,865

(22) Filed: Aug. 31, 2023

(65) Prior Publication Data

US 2024/0068157 A1 Feb. 29, 2024

Related U.S. Application Data

(60) Provisional application No. 63/402,785, filed on Aug. 31, 2022.

(51) Int. Cl.

| | |
|---|---|
| ***D06M 15/263*** | (2006.01) |
| ***D03D 1/00*** | (2006.01) |
| ***D03D 15/225*** | (2021.01) |
| ***D03D 15/283*** | (2021.01) |
| ***D03D 15/513*** | (2021.01) |
| ***D06B 1/00*** | (2006.01) |
| ***D06M 13/02*** | (2006.01) |
| ***D06M 13/144*** | (2006.01) |
| ***D06M 13/395*** | (2006.01) |

(52) U.S. Cl.

CPC ..... *D06M 15/263* (2013.01); *D03D 1/0035* (2013.01); *D03D 15/225* (2021.01); *D03D 15/283* (2021.01); *D03D 15/513* (2021.01); *D06B 1/00* (2013.01); *D06M 13/02* (2013.01); *D06M 13/144* (2013.01); *D06M 13/395* (2013.01); *D06M 2200/12* (2013.01); *D10B 2331/021* (2013.01); *D10B 2331/14* (2013.01); *D10B 2501/04* (2013.01)

(58) Field of Classification Search

CPC .... D06M 15/21; D06M 15/263; D06M 13/02; D06M 13/144; D06M 13/395; D06B 1/00; D06B 1/02; D06B 1/04; D06B 1/08

See application file for complete search history.

(56) References Cited

U.S. PATENT DOCUMENTS

| | | | | |
|---|---|---|---|---|
| 4,756,934 | A * | 7/1988 | Ukawa | D06B 5/24 118/679 |
| 5,688,758 | A | 11/1997 | Reinehr et al. | |
| 6,818,253 | B2 * | 11/2004 | Kimbrell | D06M 15/27 525/200 |
| 8,609,795 | B2 * | 12/2013 | Sugimoto | C08F 220/24 524/529 |
| 2020/0360735 | A1 * | 11/2020 | Cantin | A41D 31/065 |
| 2020/0367584 | A1 * | 11/2020 | Truesdale, III | A41D 31/10 |
| 2022/0160059 | A1 | 5/2022 | Arangdad et al. | |

FOREIGN PATENT DOCUMENTS

| | | | |
|---|---|---|---|
| CN | 101805990 | A | 8/2010 |
| WO | WO 2000/063628 | A1 | 10/2000 |

OTHER PUBLICATIONS

Asko, "Askowasher Service Manual Supplement W6441 & W6461" 1-10. Asko Washer Service Manual. Web, Https://www .manualslib. com/manual/1029116/Asko-W6441.html. Nov. 2, 2022; p. 6, table of consumption values.

Chang-Won, Lim, "LG Electronics allowed to develop ecofriendly liquid CO2 washer" 1-2 . AJUdaily. Web, Http://ajudaily.com/view/ 20211230133423844. Dec. 30, 2021: p. 1 paragraphs 1, 4.

Doedens, Lidesij Marieken, "How to take care of your rainwear" 1-48. Textllhogskolan. Web, Https://www .diva-portal.org/smash/ geVdiva2:1309323/FULL TEXT01 .pdf. Feb. 7, 2013; p. 7 Section 1.2, p. 17 paragraph 8, p. 18 paragraphs 5-6, 9, p. 19 last paragraph, p. 20 paragraphs 1, 3, p. 32 paragraph 3, p. 43 paragraphs 1, 3.

International Search Report and Written Opinion for PCT/US2023/ 031741 dated Feb. 8, 2024, 12 pages.

* cited by examiner

*Primary Examiner* — Michael P Wieczorek

(74) *Attorney, Agent, or Firm* — Dority & Manning, P.A.

(57) ABSTRACT

Protective garments are disclosed having fabric treated with a water resistant treatment. The water resistant treatment includes a combination of a water resistant concentrate and a solvent. In accordance with the present disclosure, the water resistant treatment is substantially free of fluorocarbon chemicals and yet provides not only excellent water resistance, but also excellent breathability and comfort. The water resistant treatment may be particularly applicable for use in reapplications.

29 Claims, 4 Drawing Sheets

GARMENT TREATMENT AND METHOD OF APPLICATION THEREOF

RELATED APPLICATIONS

The present application is based upon and claims priority to U.S. Provisional Patent Application Ser. No. 63/402,785, filed on Aug. 31, 2022, and which is incorporated herein by reference in its entirety.

BACKGROUND

Various different types of protective garments exist that are intended to provide protection to the wearer. In certain embodiments, for instance, the protective garments are designed to provide protection from heat and flame so as to prevent burn injuries. Such protective garments, for instance, are typically worn by firefighters, other service providers, and military personnel. Military personnel, for instance, wear such garments to provide protection against incendiary devices and the like.

Such garments should be fire resistant while also being as light as possible, strong, abrasion resistant, rip and tear resistant, flexible, and should encumber the wearer as little as possible.

In the past, one difficulty that has been encountered in designing protective garments is to prevent the garments from absorbing and retaining moisture. For instance, protective garments worn by firefighters usually become wet during use due to external exposure to extinguishing water or rain. Also, protective garments can become wet due to the absorption of perspiration given off by the wearer. Unfortunately, when the protective garment absorbs moisture, the characteristics and properties of the garment can be adversely affected. For example, when retaining moisture, the protective garment can become significantly heavier.

Besides increasing in weight, the presence of moisture within a protective garment also adversely affects the thermal properties of the garment making the garment less effective in shielding its wearer from thermal heat. In particular, since water is a much better heat conductor than air, the rate of heat transfer through the garment increases. Also, it has been discovered that as water heats up in a protective garment, the water can turn to steam under exposure to heat and actually burn a person wearing the garment.

Ultimately, when protective garments as described above become wet or soaked with water or other fluids, the garments become hot and uncomfortable to work in due to the increased weight and due to the increased rate of heat transfer through the garment. As a consequence, a wearer can only spend a limited amount of time working or performing tasks in the garment due to the possibility of heat stress.

Further, the rates of cancer among firefighters are substantially greater than that of the general population. Indeed, the rates of digestive, oral, respiratory, and urinary cancers have been institutionally verified to be substantially greater in firefighters when compared to the rates of cancer in the general population.

In their occupation, firefighters may be exposed to hundreds of different chemicals in the form of gases, vapors, and particulates. Undoubtedly, the increased number of synthetics utilized in homes and businesses has resulted in a more complex range of combustion products, many of which are hazardous. The hazardous substances may be byproducts of combustion and burning, such as polycyclic aromatic hydrocarbons, while others may come directly from the materials comprising the burning building or structure, such as asbestos. The personal protective equipment utilized by firefighters may be exposed to these hazardous substances. Many of these hazardous substances adhere to the personal protective equipment of firefighters resulting in an increased risk of exposure to both the firefighter and anyone coming into either direct or indirect contact with the firefighter or the firefighter's equipment.

As a result of the risk posed by carcinogens, garments, such as firefighter garments, are frequently washed, such as after every use, to ensure that carcinogens adhered to the protective garment are removed and disposed of. Traditionally, the washing of the garment decreases the ability of the treated protective garment to prevent the absorption and retainment of moisture. Unfortunately, as previously detailed, when the protective garment absorbs moisture, the characteristics and properties of the garment can be adversely affected.

Thus, a need currently exists for a water resistant treatment that can be applied and reapplied to protective garments or fabrics subjected to frequent washings.

SUMMARY

In general, the present disclosure is directed to a water resistant treatment that is substantially fluorocarbon-free and a method of application thereof. The water resistant treatment of the present disclosure, for instance, can contain substantially no or can be completely devoid of fluoropolymers and yet still maintain excellent water resistant properties. The water resistant treatment is particularly well suited for use on frequently washed fabrics or garments. It was unexpectedly discovered that the water resistant treatment of the present disclosure not only has excellent water resistant properties, but is capable of maintaining the water resistant properties even after multiple laundry cycles.

In one aspect, the present disclosure is directed to a process for treating a garment, the process comprising: loading the garment into a garment extractor; mixing a solvent with a water resistant concentrate in the garment extractor to form a water resistant treatment, wherein the water resistant concentrate is substantially fluorocarbon free, wherein the water resistant treatment comprises the solvent; contacting the garment with the water resistant treatment in the garment extractor such that a water resistant composition impregnates the fibers of the garment; drying the garment in a garment drying device such that the water resistant composition is cured and affixed to the fibers of the garment; and wherein the garment has a water absorption of less than about 15% after drying the garment in the garment drying device.

The process can contain a water resistant treatment and a water resistant concentrate both comprising at least one component that is not a component of the water resistant composition, such as an evaporating wetting agent.

In one aspect, the process can contain a water resistant treatment that has an acidic pH.

The process can contain a water resistant treatment comprising an acrylic copolymer.

In one aspect, the process can contain a water resistant treatment that comprises a wax. The wax may comprise a paraffin wax.

Additionally, the process may contain a water resistant treatment comprising an acrylic copolymer and a paraffin wax. The acrylic copolymer and paraffin wax may be in the form of a dispersion.

Further, the process may contain a water resistant treatment comprising one or more cross-linking agents. In one aspect, at least one cross-linking agent is a blocked isocyanate.

In one aspect, the process may contain a water resistant treatment comprising a dispersion of an acrylic copolymer and a paraffin wax along with one or more cross-linking agents, wherein the ratio of the one or more cross-linking agents to the dispersion of an acrylic copolymer and a paraffin wax is from about 1:10 to about 3:5, such as about 1:5 by weight.

In one aspect, the process may contain a water resistant treatment comprising a wetting agent. The wetting agent can be an evaporable wetting agent. The wetting agent can be isopropyl alcohol.

The curing temperature of the water resistant composition may be from about 50° C. to about 130° C., such as from about 75° C. to about 100° C.

After five laundry cycles, a garment treated with the water resistant treatment may maintain a water absorption of about 15% or less, such as about 10% or less, such as about 5% or less.

In one aspect, a garment drying device can dry the garment by evaporative drying, centrifugal extraction drying, press drying, vacuum drying, or a combination thereof. In one aspect, the garment drying device can be a tumble dryer or an oven. The oven may be a convection oven, an infrared oven, a conduction oven, or a combination thereof.

A garment treated in accordance with the present disclosure may be a flame resistant garment for turnout coats for firemen. The garment may comprise woven fabric made from at least 75% by weight flame resistant fibers. In one aspect, the flame resistant fibers may comprise PBI fibers, PBO fibers, or mixtures thereof. In another aspect, the flame resistant fibers may comprise FR cellulose fibers.

In one aspect, the solvent may be present in the water resistant treatment in an amount from about 50% to about 99.9% by weight of the water resistant treatment.

In one aspect, the solvent may be liquid carbon dioxide.

In one aspect, the present disclosure may be directed to a water resistant concentrate comprising: a water resistant composition, wherein the water resistant concentrate comprises at least one component that is not a component of the water resistant composition; wherein the water resistant concentrate is substantially fluorocarbon free, wherein the water resistant concentrate comprises a copolymer and a wax; and wherein the water resistant composition has a curing temperature from about 50° C. to about 130° C.

The water resistant concentrate may further comprise an evaporable wetting agent. The evaporable wetting agent may be present in the water resistant concentrate in an amount from about 2% to about 40% by weight of the water resistant concentrate.

In one aspect, the copolymer and the wax of the water resistant concentrate are a dispersion of an acrylic copolymer and a paraffin wax. The water resistant concentrate may further comprise one or more cross-linking agents. In one aspect, the ratio of the one or more cross-linking agents to the dispersion of an acrylic copolymer and a paraffin wax is from about 1:10 to about 3:5 by weight, such as about 1:5.

In one aspect, the present disclosure may be directed to a protective garment comprising: a fabric material comprising a woven fabric, a knitted fabric, a nonwoven fabric, or combinations thereof, the fabric material including a water resistant treatment, the water resistant treatment comprising a repelling agent, the repelling agent having a mean bio-based carbon content of at least about 25%, the fabric material containing fluorine in an amount less than about 500 ppm, and wherein the fabric material displays a water absorbency of less than about 15% after five laundry cycles.

The repelling agent may have a mean bio-based carbon content of at least about 30%, such as at least about 35%, such as at least about 40%, such as at least about 45%, such as at least about 50%, such as at least about 55%, such as at least about 60%, such as at least about 65%, such as at least about 70%. The repelling agent may comprise an acrylate, such as an alkyl acrylate. The repelling agent may comprise a hyperbranched hydrocarbon polymer with methyl end groups. In one aspect, the hyperbranched hydrocarbon polymer may have a dendritic structure.

In one aspect, the repelling agent may comprise a comb polymer.

In one aspect, the hyperbranched hydrocarbon polymer may include water repellent end groups.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
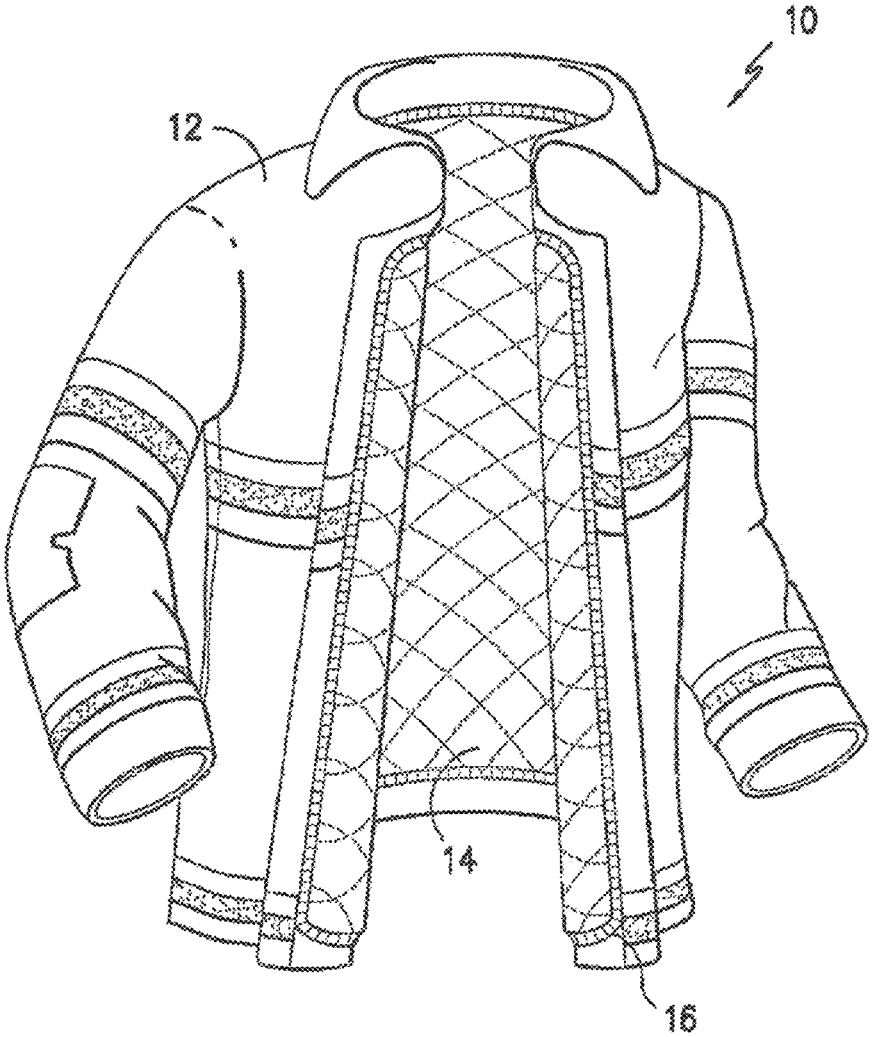
FIG. 1 is a perspective view of one embodiment of a protective garment treated in accordance with the present disclosure.

Repeat use of reference characters in the present specification and drawings is intended to represent the same or analogous features or elements of the present invention.

DEFINITIONS AND STANDARDIZED PROCEDURES

The following definitions and procedures are offered in order to better describe and quantify the performance of protective garments and fabrics made according to the present invention in comparison to prior art constructions.

Mean Bio-Based Content

Mean bio-based content can be determined according to ASTM Test.

Using a method that relies on determining the amount of radiocarbon dating isotope $^{14}C$ (half life of 5730 years) in the treatments and/or compositions described herein can identify whether the carbon in these compositions derives from a biosource—from modern plant or animals—or from a fossil source, or a mixture of these. Carbon from fossil sources generally has a $^{14}C$ amount very close to zero. Measuring the $^{14}C$ isotope amount of the polyoxymethylene [POM] polymer itself, a POM intermediate, or an article containing the POM polymer can verify that the material or article derives from a biosource of carbon and quantify the percent of biosourced carbon.

ASTM D6866 Methods A-C can be used to determine the mean biobased content by $^{14}C$ isotope determination, similar to radiocarbon dating. Determining the $^{14}C$ amount via these methods gives a measure of the Mean Biobased Content of the tested material, i.e., the amount of biobased carbon of the tested material as a percent of the weight (mass) of its total organic carbon. Method B may be used in one embodiment.

The result of the ASTM D6866 method can also be reported as percent Modern Carbon ["pMC"]. pMC is the ratio of the amount of radiocarbon ($^{14}C$) of the tested material relative to the amount of radiocarbon ($^{14}C$) of the reference standard for radiocarbon dating, which is the National Institute of Standards and Technology—USA (NIST—USA) standard of a known radiocarbon content equivalent to that of the year 1950 CE. 1950 CE was chosen in part because it represents the period before the regular testing of thermonuclear weapons, which resulted in a large increase of excess radiocarbon in the atmosphere. For those using radiocarbon dates, 1950 CE equals "zero years old". It also represents 100 pMC.

Water Repellency: Spray Test AATCC TM22-2017

As used herein, a fabric spray rating refers to a rating a fabric or a material receives according to AATCC TM22-2017. In general, a spray test measures the resistance of a material to wetting by water.

According to the present invention, the following is the procedure used to determine the spray rating of a material.

1. A 7"×7" sample of the material to be tested is first conditioned at 65 plus or minus 2% relative humidity and at 70 plus or minus 2° F. for a minimum of four hours prior to testing.
2. The fabric sample is fastened securely on a 6" metal hoop so that the fabric is wrinkle free. The hoop is supported on a tester's stand so that the fabric is facing up. Twills, gabardines, piques or similar fabrics of ribbed construction are positioned on the stand so that the ribs are diagonal to the flow of water running off the fabric. A funnel attached to a nozzle for holding water is placed 6" above the center of the fabric.
3. 250 milliliters of water at 80 plus or minus 2° F. are poured from a cup or other container into the funnel, allowing the water to spray onto the fabric.
4. Once the water has run through the funnel, one edge of the hoop is held and the opposite edge is firmly rapped once against a solid object with the fabric facing the object. The hoop is then rotated 180° and it is rapped once more at the point previously held.
5. The wetted or spotted fabric sample is then compared with the standards shown in FIGS. 3A-3F. The fabric is assigned a spray rating that corresponds to the nearest standard. As shown on FIGS. 3A-3F, the fabric can be rated from 0 to 100 wherein 0 indicates that the entire fabric is wetted with the water, while a rating of 100 indicates that none of the fabric was wetted by the water.

Water Absorption Resistance Test

The following water absorption test is for determining the resistance to water absorption of a fabric or material. The test is based upon NFPA 1971-2018, 8.25, which may be referred to as NFPA 1970. In particular, the water absorption test is conducted according to the above-identified test method after the fabric or material has been subjected to one or more laundry cycles, generally five laundry cycles, in accordance with NFPA 1971, 8-1.2 (or AATCC TM135-2018-1, V, Ai).

According to the present invention, the following is the procedure used to determine the water absorption rating of a material.

1. Three 8"×8" samples of the material to be tested are subjected to one or more laundry cycles in accordance with NFPA 1971, 8-1.2. Test method NFPA 1972, 8-1.2 is substantially similar to the laundering test described above. In this test, however, the specimens are conditioned in an atmosphere of 70 plus or minus 2° F. and 65 plus or minus 2% relative humidity before and after being washed. Further, the machine settings and parameters are as follows:
   water level normal
   wash cycle normal/cotton sturdy
   wash temperature 140+ or −5° F.
   drying cycle tumble/cotton sturdy
   detergent 66+ or −1 g of 1993 AATCC standard Reference Detergent
2. Each sample is securely mounted, with the coated side of the material up, to embroidery hoops with sufficient tension to ensure a uniformly smooth surface. The hoop is supported on a tester's stand. The material is positioned so that the direction of the flow of water down the sample shall coincide with the warpwise direction of the sample as placed on the stand. A funnel attached to a nozzle for holding water is placed 24" above the center of the material. The plane of the surface of the sample is placed at a 45° angle with the horizontal.
3. 500 ml of water at a temperature of 80+ or −2° F. are poured quickly into the funnel and allowed to spray onto the specimen.
4. As rapidly as possible, the sample is removed from the hoops and placed between two sheets of blotting paper on a flat horizontal surface. A metal roller approximately 4½" long and weighing 2¼ pounds is rolled quickly forward and back one time over the paper without application of any pressure other than the weight of the roller.
5. A square having dimensions of 4"×4" is cut out of the center of the sample and weighed to the nearest 0.05 grams. Not more than 30 seconds shall elapse between the time the water has ceased flowing through the spray nozzle and the start of the weighing.
6. The same 4"×4" square sample is then left in a conditioning room until it has dried and reached moisture equilibrium with the surrounding atmosphere. The sample is then weighed again.
7. The water absorbed shall be calculated as follows:

$$\text{water absorbtion percent} = \frac{W - O}{O} \times 100$$

herein W is the weight of the wet sample and O is the weight of the dried sample. The water absorption rating of the sample is the average of the results obtained from the three specimens tested.

DETAILED DESCRIPTION

Reference now will be made in detail to various embodiments. Each example is provided by way of explanation of the embodiments, not as a limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

In general, the present disclosure is directed to a water resistant treatment and a process for treating a protective garment that is particularly well suited to protect the user from fluids and provide an impenetrable barrier to many liquids. Notably, the efficacy of commonly employed durable water repellants is decreased as a treated garment is worn and washed. Indeed, the water repellency of such garments may decrease to an extent such that the garment becomes unsuitable for its intended use. However, the water resistant treatment of the present disclosure may be applied and/or reapplied by the user or wearer of such a garment to enhance the properties of the garment, such as the water resistance properties. In this respect, the application and/or reapplication of the water resistant treatment of the present disclosure is subject to user preference, which may be based upon applicable industry performance standards. For instance, the user or wearer of such a garment may apply and/or reapply the water resistant treatment of the present disclosure to the garment every 5 laundry cycles, every 10 laundry cycles, every 20 laundry cycles, every 30 laundry cycles, every 40 laundry cycles, or every 50 laundry cycles.

In accordance with the present disclosure, the protective garments are contacted with a water resistant treatment. The water resistant treatment may comprise a water resistant concentrate. The water resistant concentrate may comprise a water resistant composition. The properties of the water resistant composition not only hinder penetration of respiratory water droplets, but also allow for exceptional breathability and comfort. Of particular advantage, treated garments in accordance with the present disclosure also have excellent durability and can display the above properties after multiple laundry cycles.

Protective garments treated in accordance with the present disclosure can be used in all different types of fields and applications. As used herein, a protective garment refers to any article of clothing or article that is worn on the body and it can include any part of a protective ensemble. The protective garments, for instance, can be used by healthcare personnel and/or by patients and can include daily medical wear or can include more specialized garments, such as gowns, lab coats, and the like. Protective garments treated in accordance with the present disclosure can also include fire safety garments and apparel. Such protective garments can include footwear, trousers, jackets, coats, shirts, headwear, gloves, and the like. Protective garments treated in accordance with the present disclosure include, for instance, military garments, tactical garments, firefighter garments, industrial garments, and the like whether the garments are made from multiple layers or from a single layer of fabric. Further, protective garments treated in accordance with the present disclosure may include bunker gear materials and garments. The bunker gear materials and garments may comprise an outer shell, a moisture barrier, and a thermal liner. Additionally, protective garments treated in accordance with the present disclosure may be FR liners (e.g., FR helmet liners, FR glove liners, FR boot liners), FR hoods, FR flight suits (e.g., FR military flight suits), FR BDU garments, FR garments for the handling of molten metal, or FR NFPA 70E garments (e.g., Level 1, Level 2, Level 3, and Level 4 FR NFPA 70E garments).

The garments can be constructed so as to be worn in all types of environments and can be worn by people with different occupations. In one aspect, the garment may be a firefighter garment. In another aspect, the garment may be a military garment, such as a battledress uniform. The garment may also comprise various other military apparel, such as flight suits, military jackets, military parkas, and the like.

In another aspect, other fabric materials may be treated with the water resistant treatment of the present disclosure. For instance, medical bags or medical pouches (e.g., first responder bags, trauma bags, airway management bags, oxygen bags, medication bags, medical supply bags, etc.) may be treated with the water resistant treatment of the present disclosure.

It should be understood that throughout the entirety of this specification, each numerical value (e.g., weight percentage, concentration) disclosed should be read as modified by the term "about" (unless already expressly so modified) and then read again as not to be so modified. For instance, a value of "100" is to be understood as disclosing "100" and "about 100". Further, it should be understood that throughout the entirety of this specification, when a numerical range (e.g., weight percentage, concentration) is described, any and every amount of the range, including the end points and all amounts therebetween, is disclosed. For instance, a range of "1 to 100", is to be understood as disclosing both a range of "1 to 100 including all amounts therebetween" and a range of "about 1 to about 100 including all amounts therebetween". The amounts therebetween may be separated by any incremental value.

Water Resistant Treatment

In general, the water resistant treatment may contact a garment or fabric material at a number of various contact points and may contact the garment or fabric material by a number of various contact methods. For instance, the water resistant treatment may entirely envelop the garment. In this respect, the garment may be submerged in the water resistant treatment. Further, for instance, the water resistant treatment may contact only a portion of the garment or may contact the entirety of the garment. In this respect, a portion of the fibers, such as a minority or a majority of the fibers, may come into contact with the water resistant treatment such that the fibers are treated by the water resistant treatment. In another aspect, the water resistant treatment may be sprayed or printed on a garment or fabric material.

In one aspect, the garment may contact the water resistant treatment while positioned in a garment extractor. In this respect, a garment treated in accordance with the present disclosure may be loaded into a garment extractor by a user or by an apparatus. As used herein, a garment extractor indicates any apparatus or device that may contact and/or clean a garment using liquid, gas, or a combination thereof, such as a garment washing device (e.g., washing machine). In this respect, the garment extractor may be a front loading washing machine, a side loading washing machine, a top loading washing machine, a stone washing machine, or more generally any type of washing machine suitable for the washing of a garment. The garment extractor may be pressurized or unpressurized.

In one aspect, the garment extractor may be an industrial dry cleaning machine, such as a liquid carbon dioxide industrial cleaning machine.

The period of time the water resistant treatment is in contact with the garment may be referred to as the dwell time. The water resistant treatment may contact the garment for a selectively chosen dwell time such that the water resistant composition impregnates the fibers of the garment. For instance, when the water resistant treatment contacts the garment in a garment extractor, the water resistant treatment may contact the garment for a dwell time of about 10 minutes to about 120 minutes, such as about 15 minutes or more, such as about 25 minutes or more, such as about 30 minutes or more, such as about 35 minutes or more, such as about 45 minutes or more, such as about 60 minutes or more, such as about 75 minutes or more, such as about 90 minutes or more. Generally, the water resistant treatment contacts the garment for a dwell time of less than about 120 minutes, such as about 105 minutes or less, such as about 90 minutes or less, such as about 75 minutes or less, such as about 60 minutes or less, such as about 45 minutes or less, such as about 35 minutes or less, such as about 30 minutes or less, such as about 25 minutes or less, such as about 15 minutes or less.

While in the garment extractor, the water resistant treatment may be at a temperature of about 5° C. to about 95° C., such as about 5° C. or more, such as about 10° C. or more, such as about 20° C. or more, such as about 30° C. or more, such as about 40° C. or more, such as about 50° C. or more, such as about 60° C. or more, such as about 70° C. or more, such as about 80° C. or more, such as about 90° C. or more. Generally, the water resistant treatment is at a temperature of about 95° C. or less, such as about 90° C. or less, such as about 80° C. or less, such as about 70° C. or less, such as about 60° C. or less, such as about 50° C. or less, such as about 40° C. or less, such as about 30° C. or less, such as about 20° C. or less, such as about 10° C. or less.

The water resistant treatment may comprise any number of components. For instance, the water resistant treatment may comprise a solvent and a water resistant concentrate. In this respect, the solvent and the water resistant concentrate may be mixed to form the water resistant treatment. The water resistant treatment may be acidic. In one aspect, a garment extractor may mix the solvent and the water resistant concentrate such that the solvent and the water resistant concentrate form the water resistant treatment. In one aspect, the water resistant treatment of the present disclosure can be formulated to be water-based. In this respect, the solvent may be water. In yet another aspect, the solvent may comprise water, a solvent (e.g., liquid carbon dioxide, liquid silicone, perchloroethylene, a petroleum-based compound, trichloroethylene, carbon tetrachloride, 1,1,2-trichlorotrifluoroethane, 1,1,1-trichloroethane, a glycol ether, decamethylcylcopentasiloxane, n-propyl bromide), a detergent, or a combination thereof. In a further aspect, the water resistant treatment may comprise gaseous carbon dioxide.

In one aspect, the solvent may comprise liquid carbon dioxide. In this respect, the water resistant treatment may comprise liquid carbon dioxide and a water resistant concentrate. The utilization of liquid carbon dioxide in the solvent or as the solvent may result in a garment that does not require rinsing after the separation of the garment from the water resistant treatment.

In one aspect, the solvent may comprise a petroleum-based compound. In this respect, the solvent may comprise a hydrocarbon, such as an aliphatic hydrocarbon (e.g., isoparaffinic hydrocarbon, cycloparrafinic hydrocarbon).

In one aspect, the solvent may comprise a detergent. In this respect, the detergent may be an anionic detergent, a non-anionic detergent, or a cationic detergent.

In general, the water resistant treatment may comprise the solvent in an amount of about 50 wt. % to about 99.99 wt. % by weight of the water resistant treatment, such as about 50 wt. % or more, such as about 60 wt. % or more, such as about 70 wt. % or more, such as about 80 wt. % or more, such as about 90 wt. % or more, such as about 92 wt. % or more, such as about 95 wt. % or more, such as about 97 wt. % or more, such as about 99 wt. % or more. Generally, the solvent is present in the water resistant treatment in an amount by weight of about 99.99 wt. % or less, such as about 99 wt. % or less, such as about 97 wt. % or less, such as about 95 wt. % or less, such as about 92 wt. % or less, such as about 90 wt. % or less, such as about 80 wt. % or less, such as about 70 wt. % or less, such as about 60 wt. % or less.

After the water resistant treatment has made suitable contact with the garment, the garment may be separated from water resistant treatment. For instance, when the garment is submerged in the water resistant treatment in a garment extractor for a suitable dwell time, the garment may be removed from the garment extractor after the water resistant composition impregnates the fibers of the garment. The garment may then be loaded into a garment drying device, which is further discussed later in this application.

In one aspect, the garment may be directly loaded into the garment drying device after it is removed from the garment extractor without rinsing the garment. Generally, garments treated with traditional water resistant treatments require rinsing, particularly a thorough rinsing, after being treated with a water resistant treatment for a multitude of reasons. For instance, the pH of the treated garment may be undesirable for direct contact with human skin. Indeed, a fabric pH of less than 4 or greater than 8.5 may result in skin itchiness, irritation, and dermatitis. However, the treated garments of the present disclosure unexpectedly demonstrated exceptional post-cure pH values, as observed in the Examples, without the need for rinsing the garment after the separation of the garment from the water resistant treatment. This result is particularly unexpected because the water resistant treatment can be acidic.

In one aspect, where the treated material is a fabric material, the fabric material can optionally be scoured using, for instance, an alkaline solution. This may occur prior to applying the water resistant treatment. After being scoured, the fabric material can be put on a tenter frame, dried, and heat seat. For instance, after scouring, the fabric material can be dried so that the moisture level is substantially equivalent to the natural moisture level of the fibers used to make the fabric material. For instance, the moisture level can be less than about 10% by weight, such as less than about 7% by weight, and generally greater than about 3% by weight.

The water resistant treatment and/or the fabric of the present disclosure may be substantially free of fluorocarbon chemicals. Substantially free, as used herein, indicates that the fabric of the garment, the water resistant treatment, the water resistant concentrate, and/or the water resistant composition contains fluorocarbon chemicals in an amount less than about 2% by weight, such as in an amount less than about 1% by weight, such as in an amount less than about 0.5% by weight, such as in an amount less than about 0.25% by weight, such as in an amount less than about 0.1% by weight. Further, for instance, the fabric or fabric layer of the garment treated in accordance with the present disclosure can contain fluorine in an amount less than about 1,000 ppm, such as in an amount less than about 500 ppm, such as in an amount less than about 100 ppm, such as in an amount less than about 50 ppm, such as in an amount less than about 40 ppm, such as in an amount less than about 30 ppm, such as in an amount less than about 20 ppm. Further, for instance, the fabric or fabric layer of the garment treated in accordance with the present disclosure can contain fluorine in an amount less than about 1,000 ppb, such as in an amount less than about 500 ppb, such as in an amount less than about 100 ppb, such as in an amount less than about 50 ppb, such as in an amount less than about 40 ppb, such as in an amount less than about 30 ppb, such as in an amount less than about 20 ppb.

In one aspect, the water resistant treatment is free or is substantially free of perfluorinated carboxylic acids, such as free or substantially free of perfluorooctanoic acid. For example, perfluorooctanoic acid or any perfluorinated carboxylic acids may be present in the water resistant treatment and/or in a treated fabric in an amount less than about 2% by weight, such as in an amount less than about 1% by weight, such as in an amount of less than 0.5% by weight, such as in an amount less than about 0.25% by weight, such as in an amount less than about 0.1% by weight.

In another aspect, the water resistant treatment can be free or substantially free of polyfluoroalkyl compounds, including C6 compounds. For instance, the water resistant treatment and/or the treated fabric can contain one or more polyfluoroalkyl compounds in an amount less than about 2% by weight, such as in an amount less than about 1% by weight, such as in an amount less than about 0.5% by weight, such as in an amount less than about 0.25% by weight, such as in an amount less than about 0.1% by weight.

The water resistant treatment may contain a binder and/or one or more cross-linking agents combined with various other ingredients and components. For instance, the water resistant treatment may include a softener, a repelling agent, or both a softener and a repelling agent.

In one aspect, the water resistant treatment can comprise a binder. The binder contained in the water resistant treatment, in one aspect, can comprise a polyurethane polymer. Of particular advantage, the polyurethane polymer can be water-based and thus can be applied to the fabric in an aqueous dispersion. The polyurethane polymer may be a polyester/ether polyurethane polymer, such as an anionic, aliphatic polyester/ether polyurethane. In one aspect, only a single binder can be used in the formulation. In other aspects, however, multiple binders can be used as desired.

Generally, the above binder can be combined with one or more cross-linking agents. For instance, in one aspect, the water resistant treatment includes a first polyurethane polymer as described above combined with a second polyurethane polymer. The second polyurethane polymer may comprise a blocked isocyanate, such as an oxime-blocked isocyanate. The blocked isocyanate may be formed from an isocyanate moiety and a suitable blocking agent. Further, for instance, the blocked isocyanate may be formed from an NCO terminated polyurethane prepolymer.

In one aspect, the binder or first polyurethane can be present in relation to the one or more cross-linking agents or second polyurethane in a weight ratio of from about 5:1 to about 1:2 including all ratios therebetween, such as in a weight ratio of from about 4:1 to 1:1. In one aspect, the binder and the one or more cross-linking agents are present in a weight ratio of from about 3:1 to about 1.5:1 based on the dried weight of the finish.

In one aspect, the one or more cross-linking agents can comprise an ethyl acrylate polymer. In yet another aspect, the one or more cross-linking agents can comprise a blocked isocyanate and an ethyl acrylate polymer. In a further aspect, the one or more cross-linking agents can comprise a cellulosic cross-linking agent. The one or more cross-linking agents may be cationic or nonionic. The one or more cross-linking agents may be selectively chosen such that they possess suitable functionality at low curing temperatures, such as curing temperatures as disclosed herein.

Further, the one or more cross-linking agents can be self cross-linking such that cross-linking of molecular chains occurs without an additive being included to facilitate cross-linking of molecular chains. The presence of the one or more cross-linking agents is for further increasing water and oil resistance, as well as increasing abrasion resistance and improving UV stability.

The blocking agent of the blocked isocyanate can be selectively chosen from a variety of blocking agents. In one aspect, the blocking agent may be selected from phenols. For instance, phenols such as phenol, methylphenol, nonylphenol, chlorophenol, butylphenol, and alkylphenol may be used as a blocking agent. In another aspect, the blocking agent may be selected from lactams. For instance, lactams such as ε-caprolactam, β-propiolactam, γ-butyrolactam, and δ-valerolactam may be used as a blocking agent. In yet another aspect, the blocking agent may be selected from pyrazoles. For instance, pyrazoles such as pyrazole, 3,5-dimethylpyrazole, and 3,5-dimethyl-4-nitropyrazole may be used as a blocking agent. In a further aspect, the blocking agent may be selected from oximes. For instance, oximes such as methyl ethyl ketone oxime, acetone oxime, and cyclohexanone oxime may be used as a blocking agent. In yet a further aspect, the blocking agent may be selected from imidazole compounds. For instance, imidazole compounds such as imidazole, 2-methylimidazole, 2-ethylimidazole, and 2-isopropylimidazole may be used as a blocking agent.

It should be noted that all of the blocking agents previously disclosed herein comprise a non-limiting list. As such, the blocking agent may be selected from other compounds including, but not limited to, alcohols, active methylene compounds, amides, hydroxamates, bisulfite addition compounds, dicarbonyl compounds, hydroxylamines and esters of p-hydroxybenzoic acid and salicylic acid.

In one aspect, the concentration of the one or more cross-linking agents in the water resistant treatment can be from about 0.05% to about 20%, such as about 0.05% or greater, such as about 0.1% or greater, such as about 0.5% or greater, such as about 1% or greater, such as about 2% or greater, such as about 5% or greater, such as about 10% or greater, such as about 15% or greater. Generally, the concentration of the one or more cross-linking agents in the water resistant treatment is about 20% or less, such as about 15% or less, such as about 10% or less, such as about 5% or less, such as about 2% or less, such as about 1% or less, such as about 0.5% or less, such as about 0.2% or less. The aforementioned percentages may also be based on the weight of the one or more cross-linking agents in the water resistant treatment based on the weight of the water resistant treatment.

In addition to a binder and/or the one or more cross-linking agents, in one aspect, the water resistant treatment can further comprise one or more softeners. In one aspect, the softener can comprise a cross-linkable silicone elastomer. For instance, the softener may comprise an amino-functional silicone macroemulsion. In another aspect, the softener can comprise an emulsion of a polyalkylene polymer. In yet another aspect, the softener is a polyethylene polymer, such as a lower molecular weight polyethylene polymer. The softener can provide for strong fiber lubrication properties, improved sewability, improved shape recovery, and stretch recovery, increased durability to washing, and a crease-resistant finishing.

In one aspect, the water resistant treatment can also comprise a carboxylic acid. For instance, the carboxylic acid can be acetic acid. The carboxylic acid can adjust the pH of the water resistant treatment, such that the carboxylic acid increases the acidity of the water resistant treatment.

When included in the formulation, a softener can generally be present in amounts less than the binder, the repelling agent, and/or the one or more cross-linking agents. For example, in one aspect, the softener can be present in relation to the binder in a weight ratio of from about 1:1 to about 1:4, such as from about 1:1.5 to about 1:3.

The water resistant treatment can also comprise a silicone-based polymer. The silicone-based polymer can be soluble in water. Generally, the silicone-based polymer is cationic or nonionic. The silicone-based polymer can have an undiluted pH from about 8 to about 12, such as a pH of greater than about 8, such as a pH of greater than about 9, such as a pH of greater than about 10, such as a pH greater than about 11. In general, the silicone-based polymer has a pH less than about 12, such as a pH less than about 11, such as a pH less than about 10, such as a pH less than about 9. In one aspect, the silicone-based polymer has a pH of about 10. The silicone-based polymer may be utilized for enhanced water repellency, increased resistance to seam-slippage, and improved abrasion resistance, while also providing for softness.

The water resistant treatment may comprise one or more wetting agents. In one aspect, the wetting agent can comprise ethoxylated fatty alcohol, isopropyl alcohol, or a combination thereof. The wetting agent may be selectively chosen such that the wetting agent does not re-wet the garment while the garment is drying, such as in a garment drying device. The prevention of re-wetting allows the garment to properly dry and further ensures sufficient curing of the water resistant composition. In this respect, the wetting agent of the present disclosure may be selectively chosen such that the wetting agent evaporates during the drying and/or curing of the garment.

When a wetting agent is included in the water resistant treatment as disclosed herein, the wetting agent may enhance the uniformity of application of the water resistant treatment such that the water resistant composition uniformly impregnates the fibers of the garment. For instance, isopropyl alcohol may decrease the surface tension of the water resistant treatment such that the water resistant composition uniformly impregnates the fibers of the garment.

In one aspect, the concentration of the wetting agent in the water resistant treatment can be from about 0.05% to about 20%, such as about 0.05% or greater, such as about 0.1% or greater, such as about 0.5% or greater, such as about 1% or greater, such as about 2% or greater, such as about 5% or greater, such as about 10% or greater, such as about 15% or greater. Generally, the concentration of the wetting agent in the water resistant treatment is about 20% or less, such as about 15% or less, such as about 10% or less, such as about 5% or less, such as about 2% or less, such as about 1% or less, such as about 0.5% or less, such as about 0.2% or less. The aforementioned percentages may also be based on the weight of the wetting agent in the water resistant treatment by weight of the water resistant treatment.

In one aspect, the wetting agent can be nonionic. Further, the wetting agent can have a pH from about 4.0 to about 9.0, such as a pH of greater than about 4.0, such as a pH of greater than about 5.0, such as a pH of greater than about 6.0, such as a pH of greater than about 7.0, such as a pH of greater than about 8.0. Generally, the wetting agent has a pH of less than about 9.0, such as a pH of less than about 8.0, such as a pH of less than about 7.0, such as a pH of less than about 6.0, such as a pH of less than about 5.0.

The wetting agent may be present in relation to the one or more cross-linking agents or repelling agent in a weight ratio of about 1:45 to about 2:1, including all ratios therebetween, such as in a weight ratio of about 1:10, such as in a weight ratio of about 1:2.

In one aspect, the water resistant treatment and/or the water resistant concentrate may comprise at least one component that is not a component of the water resistant composition. For instance, at least one component of the water resistant treatment and the water resistant concentrate may not be present in the water resistant composition after the water resistant composition is dried and cured to the garment. In this respect, one component, such as the wetting agent (e.g., isopropyl alcohol) of the water resistant treatment may evaporate during the drying and curing of the water resistant composition.

As previously disclosed, in one aspect, the water resistant treatment may also contain one or more repelling agents. A repelling agent may include an acrylic polymer alone or in combination with a wax, such as a paraffin wax. In one aspect, the acrylic polymer may be partially, such as mostly, water-soluble when in the water resistant treatment or the water resistant concentrate. The water-solubility of the acrylic polymer may decrease or cease after the acrylic polymer dries and cures. In this respect, the acrylic polymer may be water-resistant after it dries and cures. In another aspect, the wax may be insoluble in water.

In one aspect, the repelling agent may include a polyacrylate that also serves as a binder.

In one aspect, the water resistant treatment, water resistant concentrate, and/or water resistant composition may comprise a repelling agent that is derived from sustainable resources, such as biomass. The repelling agent, for instance, can have a mean bio-based carbon content of at least about 25%, such as at least about 30%, such as at least about 35%, such as at least about 40%, such as at least about 45%, such as at least about 50%, such as at least about 55%, such as at least about 60%, such as at least about 65%, such as at least about 70%. The repelling agent, for instance, can have a bio-based carbon content of up to 100%.

Bio-based repelling agents that can be incorporated into the water resistant treatment, water resistant concentrate, and/or water resistant composition of the present disclosure include, in one embodiment, an acrylate. In an alternative embodiment, the bio-based repelling agent can be a hyperbranched hydrocarbon polymer. In still another embodiment, the bio-based acrylate repelling agent can be combined with the bio-based hyperbranched hydrocarbon polymer to form at least a portion of the water resistant treatment, water resistant concentrate, and/or water resistant composition.

The bio-based acrylate can be, for instance, an alkyl acrylate. The alkyl group, for instance, can have a carbon chain length of from about 1 carbon atom to about 32 carbon atoms including all species therebetween. In one aspect, the alkyl group can be a linear group. Alternatively, the alkyl group can be branched. In one embodiment, the alkyl group on the alkyl acrylate has a relatively small carbon chain length, such as from about C1 to about C8. For instance, the carbon chain length can be less than about 7 carbon atoms, such as less than about 6 carbon atoms, such as less than about 5 carbon atoms, such as less than about 4 carbon atoms. Alternatively, the alkyl group on the acrylate can have a carbon chain length of greater than about 8 carbon atoms, such as greater than about 10 carbon atoms, such as greater than about 12 carbon atoms, such as greater than about 14 carbon atoms, and generally less than about 28 carbon atoms, such as less than about 24 carbon atoms, such as less than about 20 carbon atoms, such as less than about 14 carbon atoms. The alkyl acrylate repelling agent, in one embodiment, can have a mean bio-based content of greater than about 20%, such as greater than about 30%, such as greater than about 40%, and less than about 100%, such as less than about 80%, such as less than about 60%, such as less than about 50%.

In addition to an alkyl acrylate repelling agent, another bio-based repelling agent based on a hyperbranched hydrocarbon structure can also be very effective at repelling liquids from a fabric while remaining durable and capable of withstanding multiple laundry cycles. The hyperbranched hydrocarbon polymer, for instance, can have a dendritic structure. The hyperbranched hydrocarbon polymer, for instance, can include water repellent end groups. In one embodiment, the hyperbranched polymer is combined with a comb polymer. The comb polymer and the hyperbranched polymer can form a relatively stable microphase for application to textile materials. In one aspect, when a bio-based hyperbranched polymer is present in the water resistant treatment, water resistant concentrate, and/or water resistant composition, the composition is free of surfactants or emulsifiers which may adversely interfere with the hyperbranched polymer and comb polymer microphase dispersion.

In one embodiment, the hyperbranched polymer can include N-alkyl groups, particularly N-methyl groups. The N-methyl groups can cross-link with the fiber surface, enhancing wash durability. The N-methyl groups can also facilitate the formation of a crystalline structure. For example, after making a bond with fiber surfaces, multiple —CH3 end groups can be aligned to form crystals in order to achieve a high level of wash durability.

In one aspect, the hyperbranched polymer is cationic and is present in a dispersion at a pH of greater than about 4, such as greater than about 5, and generally less than about 7, such as less than about 6.

The bio-based hyperbranched polymer can, in one aspect, have a mean bio-based content of greater than about 40%, such as greater than about 50%, such as greater than about 60%, and generally less than about 100%, such as less than about 90%, such as less than about 80%.

The bio-based repelling agent incorporated into the water resistant treatment, water resistant concentrate, and/or water resistant composition of the present disclosure, in one embodiment, has a relatively low cure temperature. For instance, the cure temperature can be less than about 165° C., such as less than about 155° C., such as less than about 145° C. at cure times of either 5 minutes, 10 minutes, 20 minutes, or 30 minutes. Using a bio-based repelling agent with a relatively low cure temperature, for instance, further can reduce energy requirements needed to apply the water resistant treatment to a fabric or garment.

In one aspect, the concentration of the repelling agent in the water resistant treatment can be from about 0.05% to about 20%, such as about 0.05% or greater, such as about 0.1% or greater, such as about 0.5% or greater, such as about 1% or greater, such as about 2% or greater, such as about 5% or greater, such as about 10% or greater, such as about 15% or greater. Generally, the concentration of the repelling agent in the water resistant treatment is about 20% or less, such as about 15% or less, such as about 10% or less, such as about 5% or less, such as about 2% or less, such as about 1% or less, such as about 0.5% or less, such as about 0.2% or less. The aforementioned percentages may also be based on the weight of the repelling agent in the water resistant treatment by weight of the water resistant treatment.

The repelling agent may be present in relation to the one or more cross-linking agents in a weight ratio of about 10:1 to about 1:2, including all ratios therebetween, such as in a weight ratio of about 6:1 to about 4:1, such as in a weight ratio of 5:1.

In one aspect the water resistant treatment may include one or more insect repellant agents. The one or more insect repellant agents may include any compound or combination of compounds that act to disrupt an insect's ability to target a surface or that act to discourage an insect from landing on a surface. For embodiments of the disclosure, the one or more insect repellant agents are generally hydrophobic. Moreover, the insect repellant agents may include a natural insect repellant agent (e.g., an essential oil), an active compound derived from the natural insect repellant agent, a synthetic insect repellant agent, or a combination thereof. However, in particular, certain natural insect repellant agents, such as essential oils, have been found to demonstrate lower toxicity or irritant properties compared to synthetic insect repellant agents. As an example, lemon eucalyptus essential oil includes the active compound menthane 3,8-diol, which is generally hydrophobic. Thus, an example insect-resistant fabric, in accordance with the disclosure, can include lemon eucalyptus essential oil and/or menthane 3,8-diol incorporated into a base fabric along with one or more micelles and, optionally, an insecticide.

A non-limiting list of natural insect repellant agents in accordance with the disclosure includes the essential oils citronella, lemon eucalyptus, lavender, peppermint, sweet basil, catnip, tea tree, rosemary, sage, neem, geranium, garlic, lemongrass, or combinations thereof.

A non-limiting list of synthetic insect repellant agents in accordance with the disclosure includes: Methyl anthranilate and other anthranilate-based insect repellant agents, Benzaldehyde, N,N-Diethyl-m-toluamide (DEET), Dimethyl carbate, Dimethyl phthalate, Ethylhexanediol, 1-(1-Methylpropoxycarbonyl)-2-(2-hydroxyethyl) piperidine (Picardin), Butopyronoxyl, Ethyl butylacetylaminopropionate, (IR3535) and 2,3,5,6-Tetrafluoro-4-(methoxymethyl) benzyl 2,2-dimethyl-3-(prop-1-en-1-yl)cyclopropanecarboxylate. (Dimefluthrine). 1,2,4-Ethoxyphenyl-2-methylpropoxy methyl-3-phenoxybenzene (Etofenprox), 3,2,2-dichlorovinyl-2,2 dimethylcyclopropanecarboxylic acid (Permethrin).

In one aspect, the concentration of the insect repellant agent in the water resistant treatment can be from about 0.05% to about 20%, such as about 0.05% or greater, such as about 0.1% or greater, such as about 0.5% or greater, such as about 1% or greater, such as about 2% or greater, such as about 5% or greater, such as about 10% or greater, such as about 15% or greater. Generally, the concentration of the insect repellant agent in the water resistant treatment is about 20% or less, such as about 15% or less, such as about 10% or less, such as about 5% or less, such as about 2% or less, such as about 1% or less, such as about 0.5% or less, such as about 0.2% or less. The aforementioned percentages may also be based on the weight of the insect repellant agent in the water resistant treatment by weight of the water resistant treatment.

In one aspect, the water resistant treatment may include an insecticide composition. The insecticide composition may include one or more insecticidal agents that function to kill an insect. For embodiments of the disclosure, the insecticide composition may have biocidal activity beyond targeting insects (e.g., the insecticide may also target arachnids, nematodes, or annelids). In certain embodiments, the insecticide composition can be a broad-spectrum insecticide composition, such that the one or more insecticidal agents can function to kill various insect species (e.g., mosquitos, ants, beetles, flies, bees, etc.). In some embodiments, the insecticide composition may include one or more insecticidal agents tailored to one or more insect species, such that insecticide composition can function to kill only a certain insect species.

A non-limiting example of an insecticide composition in accordance with the disclosure includes pyrethroid compounds. Example pyrethroid compounds include: Allethrin, Bifenthrin, Cyfluthrin, Cypermethrin, Cyphenothrin, Deltamethrin, Esfenvalerate, Etofenprox, Fenpropathrin, Fenvalerate, Flucythrinate, Flumethrin, Imiprothrin, lambda-Cyhalothrin, Metofluthrin, Permethrin, Resmethrin, Silafluofen, Sumithrin, tau-Fluvalinate, Tefluthrin, Tetramethrin, Tralomethrin, Transfluthrin, or combinations thereof.

In one aspect, the concentration of the insecticide composition in the water resistant treatment can be from about 0.05% to about 20%, such as about 0.05% or greater, such as about 0.1% or greater, such as about 0.5% or greater, such as about 1% or greater, such as about 2% or greater, such as about 5% or greater, such as about 10% or greater, such as about 15% or greater. Generally, the concentration of the insecticide composition in the water resistant treatment is about 20% or less, such as about 15% or less, such as about 10% or less, such as about 5% or less, such as about 2% or less, such as about 1% or less, such as about 0.5% or less, such as about 0.2% or less. The aforementioned percentages may also be based on the weight of the insecticide composition in the water resistant treatment by weight of the water resistant treatment.

Water Resistant Concentrate

As previously disclosed, the water resistant treatment may comprise a water resistant concentrate. Similar to water resistant treatment, in one aspect, the water resistant concentrate may be free or substantially free of fluorocarbon chemicals. For instance, the water resistant concentrate may be free or substantially free of perfluorinated carboxylic acids, such as perfluorooctanoic acid.

The water resistant concentrate may comprise any and all components of the water resistant treatment. Consequently, the water resistant concentrate may comprise one or more cross-linking agents, one or more wetting agents, and/or one or more repelling agents.

In one aspect, the amount of the one or more cross-linking agents present in the water resistant concentrate by weight of the water resistant concentrate can be about 0.5 wt. % or greater, such as about 1 wt. % or greater, such as about 2 wt. % or greater, such as about 5 wt. % or greater, such as about 7 wt. % or greater, such as about 10 wt. % or greater, such as about 20 wt. % or greater, such as about 30 wt. % or greater, such as about 40 wt. % or greater, such as about 50 wt. % or greater, such as about 60 wt. % or greater, such as about 70 wt. % or greater, such as about 80 wt. % or greater, such as about 90 wt. % or greater. Generally, the amount of the one or more cross-linking agents present in the water resistant concentrate by weight of the water resistant concentrate is about 100 wt. % or less, such as about 90 wt. % or less, such as about 80 wt. % or less, such as about 70 wt. % or less, such as about 60 wt. % or less, such as about 50 wt. % or less, such as about 40 wt. % or less, such as about 30 wt. % or less, such as about 20 wt. % or less, such as about 10 wt. % or less, such as about 7 wt. % or less, such as about 5 wt. % or less, such as about 2 wt. % or less, such as about 1 wt. % or less. The aforementioned percentages may also be based on the concentration of the one or more cross-linking agents in the water resistant concentrate.

In one aspect, the amount of the wetting agent present in the water resistant concentrate by weight of the water resistant concentrate can be about 0.5 wt. % or greater, such as about 1.0 wt. % or greater, such as about 2.0 wt. % or greater, such as about 5.0 wt. % or greater, such as about 7.0 wt. % or greater, such as about 10 wt. % or greater, such as about 20 wt. % or greater, such as about 30 wt. % or greater, such as about 40 wt. % or greater, such as about 50 wt. % or greater, such as about 60 wt. % or greater, such as about 70 wt. % or greater, such as about 80 wt. % or greater, such as about 90 wt. % or greater. Generally, the amount of the wetting agent present in the water resistant concentrate by weight of the water resistant concentrate is about 100 wt. % or less, such as about 90 wt. % or less, such as about 80 wt. % or less, such as about 70 wt. % or less, such as about 60 wt. % or less, such as about 50 wt. % or less, such as about 40 wt. % or less, such as about 30 wt. % or less, such as about 20 wt. % or less, such as about 10 wt. % or less, such as about 7.0 wt. % or less, such as about 5.0 wt. % or less, such as about 2.0 wt. % or less, such as about 1.0 wt. % or less. The aforementioned percentages may also be based on the concentration of the wetting agent in the water resistant concentrate.

In one aspect, the amount of the repelling agent present in the water resistant concentrate by weight of the water resistant concentrate can be about 5 wt. % or greater, such as about 10 wt. % or greater, such as about 20 wt. % or greater, such as about 30 wt. % or greater, such as about 40 wt. % or greater, such as about 50 wt. % or greater, such as about 60 wt. % or greater, such as about 70 wt. % or greater, such as about 80 wt. % or greater, such as about 90 wt. % or greater. Generally, the amount of the repelling agent present in the water resistant concentrate by weight of the water resistant concentrate is about 100 wt. % or less, such as about 90 wt. % or less, such as about 80 wt. % or less, such as about 70 wt. % or less, such as about 60 wt. % or less, such as about 50 wt. % or less, such as about 40 wt. % or less, such as about 30 wt. % or less, such as about 20 wt. % or less, such as about 10 wt. % or less. The aforementioned percentages may also be based on the concentration of the repelling agent in the water resistant concentrate.

In addition to the one or more cross-linking agents, one or more wetting agents, and one or more repelling agents, the water resistant concentrate of the present disclosure may comprise other components, such as a softener or a binder, in an amount from about 0 wt. % to about 100 wt. % by weight of the water resistant concentrate, including all increments of 0.1 wt. % therebetween. The aforementioned percentages may also be based on the concentration of the respective component in the water resistant concentrate.

In one aspect, one or more components of the water resistant concentrate may be in a liquid or solid state of matter prior to and/or following the mixture of the water resistant concentrate with a solvent to form the water resistant treatment. In one aspect, a change from a solid state component to a liquid state component may occur upon the contact of the solvent with the water resistant concentrate or may occur at a temperature that is selectively chosen to change one or more components of the water resistant concentrate from a solid state component to a liquid state component. Additionally, one or more components of the water resistant concentrate may be agitated after being introduced to the solvent, such as in a garment extractor, to result in a change from a solid state component to a liquid state component.

Alternatively, when a component of the water resistant concentrate is solid prior to the mixture of the water resistant concentrate with solvent, the solid component may remain a solid component while in the water resistant treatment and more generally may remain a solid component throughout the entire process as disclosed herein.

In one aspect, the water resistant concentrate may be introduced to the solvent in an enclosure (e.g., sealed pouch) containing the water resistant concentrate. In this respect, in one aspect, the water resistant concentrate may be placed in an enclosure, such as an organic or inorganic enclosure, and the enclosure contacted with the solvent in a garment extractor. The enclosure may be soluble in the solvent.

In another aspect, the enclosure containing the water resistant concentrate may be a drum, bucket, or the like. The enclosure may have generally any volumetric size. For instance, the enclosure may have a size of 0.1 gallons or more, such as 1 gallon or more, such as 5 gallons or more, such as 10 gallons or more. The water resistant concentrate in the enclosure may be metered into the garment extractor at a selectively chosen rate.

In one aspect, the water resistant concentrate may be added or placed in the cleaning chamber of a garment extractor, such as a liquid carbon dioxide industrial cleaning machine. The cleaning chamber may be the same enclosure where gaseous carbon dioxide is pressurized into liquid form.

Water Resistant Composition

As used herein, the water resistant composition refers to a composition that impregnates the fibers of the garment and is cured and affixed to the fibers of the garment after the drying of the garment. The water resistant composition may comprise any and all components of the water resistant concentrate. Consequently, in one aspect, the water resistant composition can comprise one or more cross-linking agents, one or more wetting agents, and one or more repelling agents. Similar to the water resistant concentrate, in one aspect, the water resistant composition may be free or substantially free of fluorocarbon chemicals. For instance, the water resistant composition may be free or substantially free of perfluorinated carboxylic acids, such as perfluorooctanoic acid.

In one aspect, the amount of the one or more cross-linking agents present in the water resistant composition by weight of the water resistant composition can be about 0.5 wt. % or greater, such as about 1 wt. % or greater, such as about 2 wt. % or greater, such as about 5 wt. % or greater, such as about 7 wt. % or greater, such as about 10 wt. % or greater, such as about 20 wt. % or greater, such as about 30 wt. % or greater, such as about 40 wt. % or greater, such as about 50 wt. % or greater, such as about 60 wt. % or greater, such as about 70 wt. % or greater, such as about 80 wt. % or greater, such as about 90 wt. % or greater. Generally, the amount of the one or more cross-linking agents present in the water resistant composition by weight of the water resistant composition is about 100 wt. % or less, such as about 90 wt. % or less, such as about 80 wt. % or less, such as about 70 wt. % or less, such as about 60 wt. % or less, such as about 50 wt. % or less, such as about 40 wt. % or less, such as about 30 wt. % or less, such as about 20 wt. % or less, such as about 10 wt. % or less, such as about 7 wt. % or less, such as about 5 wt. % or less, such as about 2 wt. % or less, such as about 1 wt. % or less. The aforementioned percentages may also be based on the concentration of the one or more cross-linking agents in the water resistant composition.

In one aspect, the amount of the wetting agent present in the water resistant composition by weight of the water resistant composition can be about 0.5 wt. % or greater, such as about 1.0 wt. % or greater, such as about 2.0 wt. % or greater, such as about 5.0 wt. % or greater, such as about 7.0 wt. % or greater, such as about 10 wt. % or greater, such as about 20 wt. % or greater, such as about 30 wt. % or greater, such as about 40 wt. % or greater, such as about 50 wt. % or greater, such as about 60 wt. % or greater, such as about 70 wt. % or greater, such as about 80 wt. % or greater, such as about 90 wt. % or greater. Generally, the amount of the wetting agent present in the water resistant composition by weight of the water resistant composition is about 100 wt. % or less, such as about 90 wt. % or less, such as about 80 wt. % or less, such as about 70 wt. % or less, such as about 60 wt. % or less, such as about 50 wt. % or less, such as about 40 wt. % or less, such as about 30 wt. % or less, such as about 20 wt. % or less, such as about 10 wt. % or less, such as about 7.0 wt. % or less, such as about 5.0 wt. % or less, such as about 2.0 wt. % or less, such as about 1.0 wt. % or less. The aforementioned percentages may also be based on the concentration of the wetting agent in the water resistant composition.

In one aspect, the amount of the repelling agent present in the water resistant composition by weight of the water resistant composition can be about 5 wt. % or greater, such as about 10 wt. % or greater, such as about 20 wt. % or greater, such as about 30 wt. % or greater, such as about 40 wt. % or greater, such as about 50 wt. % or greater, such as about 60 wt. % or greater, such as about 70 wt. % or greater, such as about 80 wt. % or greater, such as about 90 wt. % or greater. Generally, the amount of the repelling agent present in the water resistant composition by weight of the water resistant composition is about 100 wt. % or less, such as about 90 wt. % or less, such as about 80 wt. % or less, such as about 70 wt. % or less, such as about 60 wt. % or less, such as about 50 wt. % or less, such as about 40 wt. % or less, such as about 30 wt. % or less, such as about 20 wt. % or less, such as about 10 wt. % or less. The aforementioned percentages may also be based on the concentration of the repelling agent in the water resistant composition.

In addition to the one or more cross-linking agents, one or more wetting agents, and one or more repelling agents, the water resistant composition of the present disclosure may comprise other components, such as a softener or a binder, in an amount from about 0 wt. % to about 100 wt. % by weight of the water resistant composition, including all increments of 0.1 wt. % therebetween. The aforementioned percentages may also be based on the concentration of the respective component in the water resistant composition.

As previously disclosed, in one aspect, the contacting of the garment with the water resistant treatment results in the water resistant composition impregnating the fibers of the garment. After the fibers of the garment have been impregnated with the water resistant composition, the garment is then dried or heated to a temperature sufficient for the water resistant composition to dry and/or cure. In one aspect, once the water resistant composition is cured and affixed to a fabric, the fabric can then be used in constructing protective garments in accordance with the present disclosure. In one aspect, the water resistant composition is selectively designed to cure at a low curing temperature, such as the curing temperature of a tumble dryer.

As previously disclosed herein, in one aspect, the water resistant composition may be dried and cured in a garment drying device. A garment drying device as used herein indicates any apparatus, system, or device that may dry a garment. For instance, the garment drying device may include a tumble dryer or an oven. For instance, the oven may be a convection oven, an infrared oven, a conduction oven, or a combination thereof. Further, the garment drying device of the present disclosure may dry the garment by various methods individually or in combination. For instance, the garment drying device may dry the garment by evaporative drying, centrifugal extraction drying, press drying, vacuum drying, or a combination thereof.

Generally, the garments may be dried in any garment drying environment. For instance, the garments may be dried in a heated room until the water resistant composition is dried and cured. In another aspect, the garments may be dried via airflow. In this respect, the garments may be hung in a room and subjected to airflow until the water resistant composition is dried and cured. Notably, airflow may be achieved, for instance, by one or more vacuums and/or fans. In one aspect, the garments may be hung in a room and air dry until the water resistant composition is dried and cured.

In general, when dried via airflow, the airflow volume utilized to dry and cure a water resistant composition on a garment may be from about 100 cfm to about 1400 cfm, such as about 100 cfm or more, such as about 200 cfm or more, such as about 400 cfm or more, such as about 600 cfm or more, such as about 800 cfm or more, such as about 1000 cfm or more, such as about 1200 cfm or more, such as about 1400 cfm or less, such as about 1200 cfm or less, such as about 1000 cfm or less, such as about 800 cfm or less, such as about 600 cfm or less, such as about 400 cfm or less. In one aspect, a Ram Air Gear Dryer, such as a model TG-8 or TG-8H, may be utilized to dry and cure a water resistant composition on a garment.

A garment treated in accordance with the present disclosure may be dried such that the water resistant composition is uniformly applied to the garment. In this respect, the water resistant composition can be uniformly cured to the garment without the use of press drying or ironing. Indeed, as detailed in the Examples, utilizing a tumble dryer for the drying and curing of the water resistant composition was demonstrated to unexpectedly provide garments with exceptional water resistant properties and water resistant composition uniformity.

In one aspect, the water resistant composition may be dried and cured, such as by airflow or by tumble dryer, at a temperature of about 20° C. to about 130° C., such as about 20° C. or more, such as about 30° C. or more, such as about 40° C. or more, such as about 50° C. or more, such as about 60° C. or more, such as about 70° C. or more, such as about 80° C. or more, such as about 90° C. or more, such as about 100° C. or more, such as about 110° C. or more, such as about 120° C. or more. Generally, the water resistant composition is dried and cured at a temperature of about 130° C. or less, such as about 120° C. or less, such as about 110° C. or less, such as about 100° C. or less, such as about 90° C. or less, such as about 80° C. or less, such as about 70° C. or less, such as about 60° C. or less, such as about 50° C. or less, such as about 40° C. or less, such as about 30° C. or less.

In one aspect, the water resistant composition may be dried and cured in a garment drying device, such as at a temperature of about 70° C. to about 105° C., such as a temperature of about 80° C. to about 95° C., such as a temperature of about 85° C. to about 90° C.

In one aspect, the water resistant composition may have an enhanced cure time. For instance, the water resistant composition of the present disclosure may have a cure time of about 15 minutes to about 1 hour, such as a cure time of about 15 minutes or more, such as a cure time of about 20 minutes or more, such as a cure time of about 25 minutes or more, such as a cure time of about 30 minutes or more, such as a cure time of about 35 minutes or more, such as a cure time of about 40 minutes or more, such as a cure time of about 45 minutes or more, such as a cure time of about 50 minutes or more. The cure time of the water resistant composition is generally about 1 hour or less, such as about 55 minutes or less, such as about 50 minutes or less, such as about 45 minutes or less, such as about 40 minutes or less, such as about 35 minutes or less, such as about 30 minutes or less, such as about 25 minutes or less, such as about 20 minutes or less.

The water resistant composition may be impregnated into a fabric material or garment such that the material maintains a spray rating of at least 70, such as at least 80, such as at least 90, such as at least 95, such as 100, after five laundry cycles. The fabric material or garment may be tested for its spray rating according to Spray Test AATCC TM22-2017. The aforementioned spray ratings may also apply to a fabric material or garment after ten laundry cycles, fifteen laundry cycles, twenty laundry cycles, or twenty-five laundry cycles. The fabric material or garment can also maintain a water absorption of about 15% or less, such as about 10% or less, such as about 5% or less, such as about 4% or less, such as about 3% or less, such as about 2% or less, such as about 1% or less, after five laundry cycles. The fabric material or garment may be tested for its water absorption according to NFPA 1971-2018, 8.25. The aforementioned water absorption values may also apply to a fabric material or garment after ten laundry cycles, fifteen laundry cycles, twenty laundry cycles, or twenty-five laundry cycles.

Figures and Additional Disclosures

In one embodiment, fabric material may be used to construct a garment worn by firefighters. For instance, referring to FIG. 1, one embodiment of a fireman turnout coat 10 constructed in accordance with the present disclosure is illustrated. Garment 10 includes a relatively tough outer shell 12 having a liner assembly 14 located therein. Outer shell 12 and liner assembly 14 together function to protect a wearer from heat and flame such as may be encountered during firefighting activities.

In the illustrated embodiment, liner assembly 14 is constructed as a separate unit that may be removed from outer shell 12. A zipper 16 is provided for removably securing liner assembly 14 to outer shell 12. It should be appreciated, however, that other suitable means of attachment, including a more permanent type of attachment such as stitches, may also be used between liner assembly 14 and outer shell 12.

Figure 2:
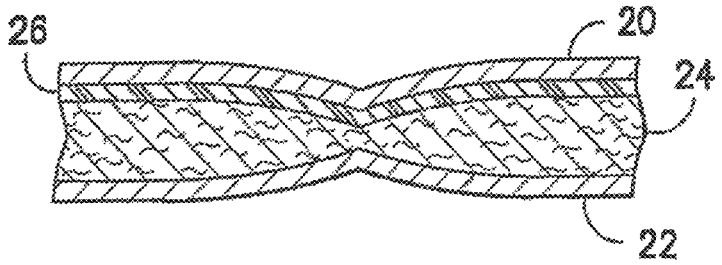
FIG. 2 is a cross-sectional view of an inner liner incorporated into the garment illustrated in FIG. 1.
Figure 3:
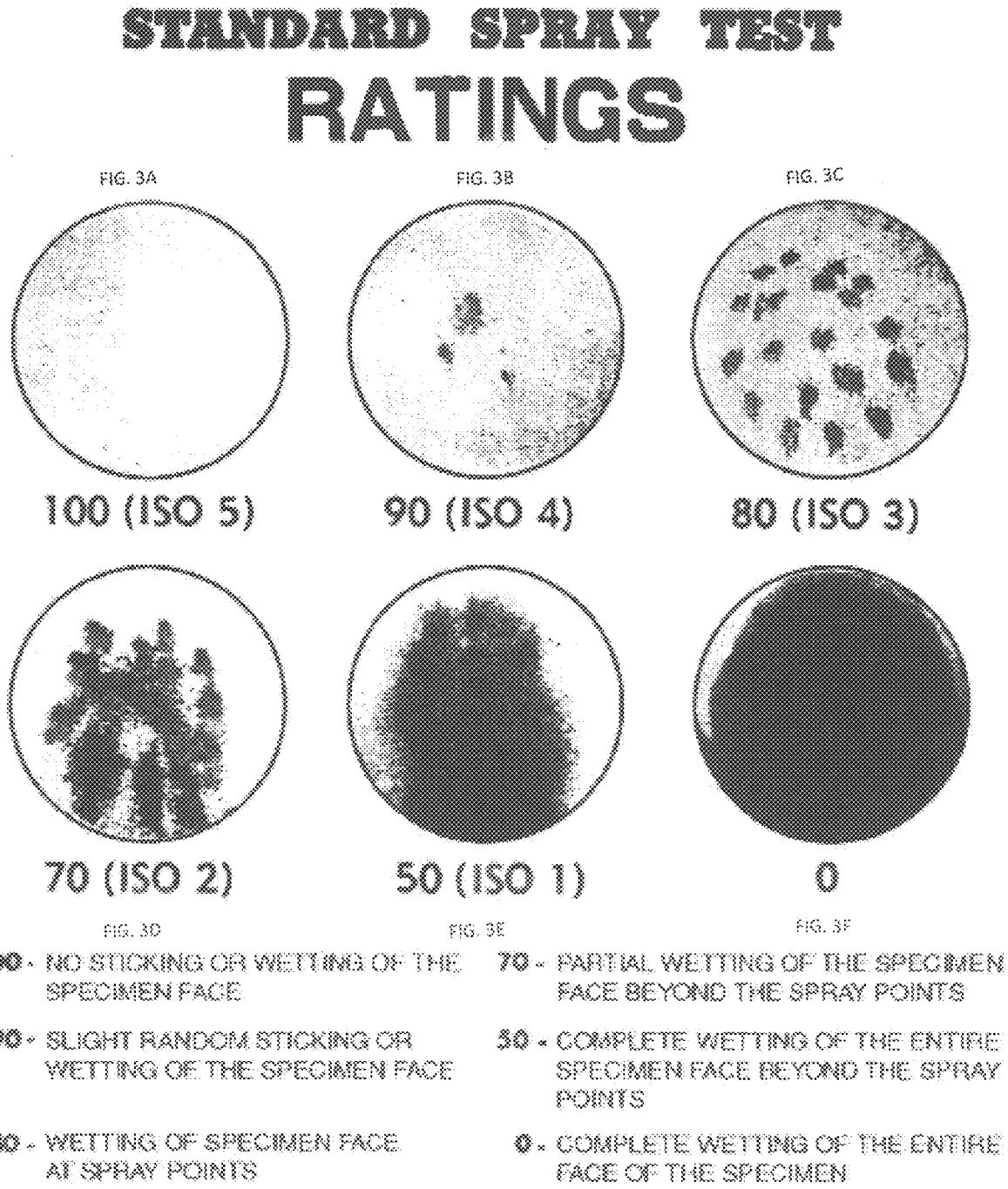
FIGS. 3A-3F are diagrammatical views of illustrative examples of spray ratings for a standardized fabric spray test.

The construction of protective garment 10 is more particularly illustrated in FIG. 2. As shown, liner assembly 14 includes a plurality of material layers quilted together. The outermost layers, i.e. lining layers 20 and 22, are connected together about their respective peripheries to form an inner cavity. A thermal barrier layer 24 and a moisture barrier layer 26 are located within the inner cavity, as shown. Typically, lining layer 20 will be adjacent the wearers body during use, whereas lining layer 22 will be adjacent outer shell 12.

Thermal barrier layer 24 can be made from various materials. For instance, an aramid felt, such as a felt produced from NOMEX meta-aramid fibers obtained from DuPont can be used. The felt functions as an insulator to inhibit transfer of heat from the ambient-environment to the wearer.

Moisture barrier 26 is preferably a suitable polymeric membrane that is impermeable to liquid water but is permeable to water vapor. Moisture barrier layer 26 is designed to prevent water contacting the exterior surface of garment 10 from reaching the wearer while at the same time permitting the escape of perspiration from the wearer.

In the embodiment described above, the fireman turnout coat 10 includes multiple layers. In other embodiments, however, it should be understood that a coat or jacket treated in accordance with the present disclosure may include a single layer or may include an outer shell attached to a liner. For example, wildland firefighter garments are typically one or two layers.

Figure 4:
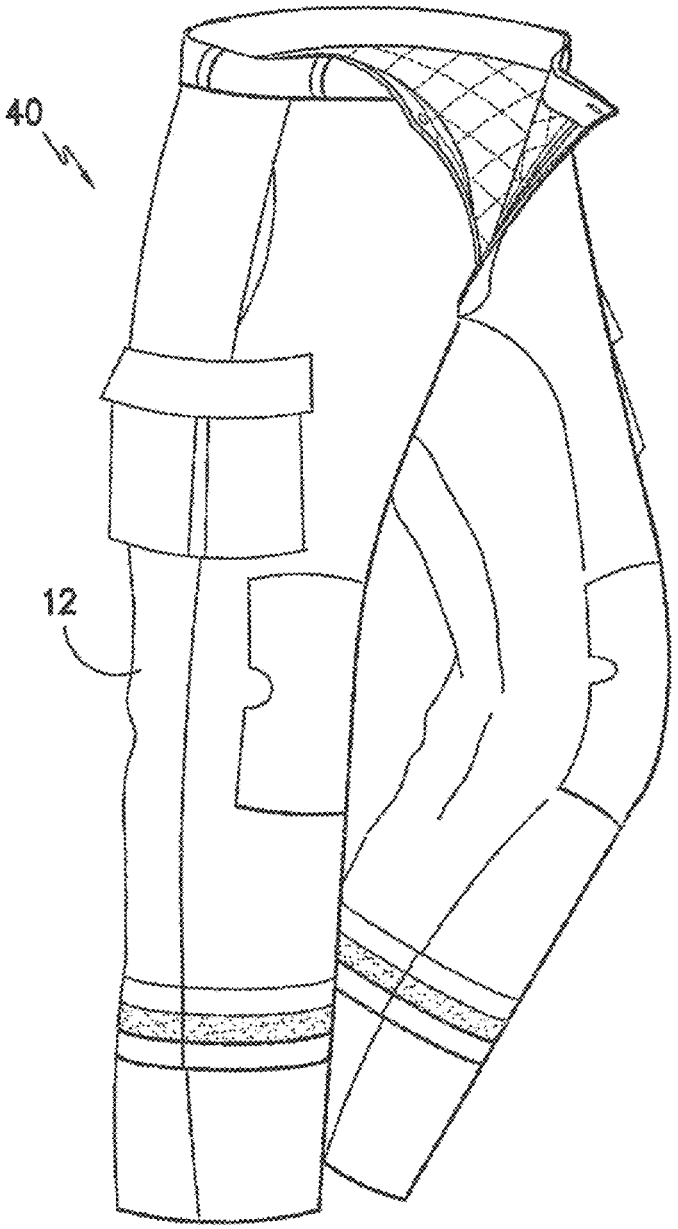
FIG. 4 is a perspective view of one embodiment of a protective garment comprising trousers treated in accordance with the present disclosure.

Referring to FIG. 4, a pair of trousers treated in accordance with the present disclosure is shown. The trousers 40 as shown in FIG. 4 can be used in conjunction with the turnout coat 10 illustrated in FIG. 1. The trousers 40 also include an outer shell 12 made from the fabric material of the present disclosure.

Any of the fabric layers illustrated in the figures can be treated in accordance with the present disclosure. For instance, the outer shell 12, the lining layer 20, the lining layer 22, and/or the thermal barrier layer 24 as shown in FIGS. 1 and 2 can be treated in accordance with the present disclosure with a water resistant treatment that is free of fluorocarbon chemicals. The fabric material can be a woven or knitted fabric and, in one embodiment, contains inherently flame resistant fibers. For example, the fabric material can contain inherently flame resistant fibers in an amount greater than about 50% by weight, such as in an amount greater than about 60% by weight, such as in an amount greater than about 70% by weight, such as in an amount greater than about 80% by weight, such as in an amount greater than about 90% by weight, such as in an amount greater than about 95% by weight. In one embodiment, for instance, the fabric material is made exclusively from inherently flame resistant fibers or contains inherently flame resistant fibers in an amount up to about 97% by weight, such as about 98% by weight. The inherently flame resistant fibers can include, for instance, aramid fibers such as para-aramid fibers and/or meta-aramid fibers. Other inherently flame resistant fibers include polybenzimidazole (PBI) fibers or poly(p-phenylene-2,6-bezobisoxazole) (PBO fibers) and the like. In one embodiment, for instance, the fabric material only contains aramid fibers such as para-aramid fibers alone or in combination with meta-aramid fibers. In still another embodiment, the fabric material contains only meta-aramid fibers. In still another embodiment, the fabric material contains aramid fibers in combination with PBI fibers. The PBI fibers can be present in the fabric material, for instance, in an amount greater than about 20% by weight, such as in an amount greater than about 25% by weight, such as in an amount greater than about 30% by weight, such as in an amount greater than about 35% by weight, such as in an amount greater than about 40% by weight, such as in an amount greater than about 45% by weight, such as in an amount greater than about 50% by weight, and generally in an amount less than about 70% by weight, such as in an amount less than about 60% by weight.

In addition to any of the inherently flame resistant fibers described above, the fabric material may contain other fibers. For instance, the fabric material may also include fibers treated with a flame retardant such as FR cellulose fibers including FR viscose fibers and FR rayon fibers. In addition, the fabric material may include antistatic fibers, nylon fibers, and the like. For example, a fabric materials treated in accordance with the present disclosure can contain nylon fibers in an amount up to about 20% by weight. For instance, nylon fibers can be present in an amount of from about 18% to about 2% by weight, such as from about 15% to about 8% by weight.

The yarns used to produce the fabric material can vary depending upon the particular application and the desired result. In one embodiment, for instance, the fabric material may contain only spun yarns, may contain only filament yarns, or may contain both spun yarns and filament yarns. The number ratio between spun yarns and filament yarns, for instance, can be from about 1:1 to about 10:1. For example, in one embodiment, the fabric material may contain spun yarns to filament yarns in a number ratio of from about 2:1 to about 4:1. When the fabric material is a woven fabric, the fabric can have any suitable weave such as a plain weave, a twill weave, a rip stop weave, or the like.

In one embodiment, the filament yarns may be made from an inherently flame resistant material. For example, the filament yarns may be made from an aramid filament, such as a para-aramid or a meta-aramid filament.

In other embodiments, the filament yarns may be made from other flame resistant materials. For instance, the filament yarns may be made from poly-p-phenylenebenzobisoxazole fibers (PBO fibers), and/or FR cellulose fibers, such as FR viscose filament fibers.

The filament yarns can be combined with spun yarns. Alternatively, the fabric material can be made using only filament yarns or only spun yarns. In accordance with the present disclosure, the spun yarns, in one embodiment, may contain polybenzimidazole fibers alone or in combination with other fibers. For example, in one embodiment, the spun yarns may contain polybenzimidazole fibers in combination with aramid fibers, such as para-aramid fibers, meta-aramid fibers, or mixtures thereof.

Instead of or in addition to containing polybenzimidazole fibers, the spun yarns may contain aramid fibers as described above, modacrylic fibers, preoxidized carbon fibers, melamine fibers, polyamide imide fibers, polyimide fibers, and mixtures thereof.

In one particular embodiment, the spun yarns contain polybenzimidazole fibers in an amount greater than about 30% by weight, such as in an amount greater than about 40% by weight. The polybenzimidazole fibers may be present in the spun yarns in an amount less than about 60% by weight, such as in an amount less than about 55% by weight. The remainder of the fibers, on the other hand, may comprise para-aramid fibers.

In one embodiment, various other fibers may be present in the spun yarns. When the fabric is used to produce turnout coats for firemen, the spun yarns can be made exclusively from inherently flame resistant fibers. When the fabric is being used in other applications, however, various other fibers may be present in the spun yarns. For instance, the spun yarns may contain fibers treated with a fire retardant, such as FR cellulose fibers. Such fibers can include FR cotton, FR rayon, FR acetate, FR triacetate, and FR lyocell, and the like. The spun yarns may also contain nylon fibers if desired, such as antistatic fibers.

In one aspect, the fabric treated with the water resistant treatment may comprise an outer shell material. The weight of the outer shell material can vary depending upon the particular type of protective garment being produced. The weight of the outer shell material, for instance, is generally greater than about 4 ounces per square yard, such as greater than about 5 ounces per square yard, such as greater than about 5.5 ounces per square yard, such as greater than about 6 ounces per square yard and generally less than about 8.5 ounces per square yard, such as less than about 8 ounces per square yard, such as less than about 7.5 ounces per square yard.

In another aspect, the fabric material treated in accordance with the present disclosure is a liner fabric. The liner fabric, for instance, can be positioned adjacent to the wearer's body during use. The lining fabric can be made from a combination of spun yarns and filament yarns as described above. The filament yarns can have a size of greater than about 100 denier, such as greater than about 200 denier, and less than about 500 denier, such as less than about 400 denier. In order to increase the lubricity of the liner fabric, the spun yarns and filament yarns can be woven together such that the filament yarns comprise more than about 50% of the surface area of one side of the fabric. For instance, the filament yarns may comprise greater than about 60%, such as greater than about 70%, such as greater than about 80% of one side of the fabric. The side of the fabric with more exposed filament yarns is then used as the interior face of the garment. The filament yarns provide a fabric with high lubricity characteristics that facilitates donning of the garment. For example, the lining fabric can be woven together using a twill weave, such as a 2×1 or 3×1 weave. The lining fabric can have a basis weight of less than about 5 ounces per square yard, such as less than about 4 ounces per square yard, and generally greater than about 2.5 ounces per square yard, such as greater than about 3 ounces per square yard.

In another aspect, the fabric material treated in accordance with the present disclosure is the barrier layer 24 as shown in FIG. 2. Barrier layer 24, for instance, can comprise a batting material, such as a felt. Once treated, the layer 24 can have the same characteristics as described above with respect to spray rating and water absorption.

Fabric materials made according to the present disclosure may also display excellent resistance to artificial blood. When tested against artificial blood, for instance, fabric materials made according to the present disclosure can display an index of repellency of greater than about 85%, such as greater than about 87%, such as greater than about 90%, such as greater than about 92%, such as greater than about 94%. The fabric materials can display an index of penetration against artificial blood of less than about 4%, such as less than about 1.5%, such as less than about 1%, such as less than about 0.8%.

Fabric materials treated in accordance with the present disclosure can also display excellent abrasion resistance. For example, a fabric having a basis weight of from about 5 osy to about 9 osy, such as from about 5.5 osy to about 8.5 osy, such as from about 6 osy to about 7.5 osy can have an abrasion resistance of greater than about 90,000 cycles, such as greater than about 95,000 cycles, such as greater than about 98,000 cycles, such as greater than about 100,000 cycles when tested according to ASTM D4966 Test Method. The abrasion resistance is generally less than about 150,000 cycles.

When testing lighter fabrics, such as linear materials, fabric materials made according to the present disclosure can have an abrasion resistance of greater than about 40,000 cycles, such as greater than about 42,000 cycles, such as greater than about 44,000 cycles, such as greater than about 46,000 cycles, such as greater than about 48,000 cycles, and generally less than about 80,000 cycles. The lighter fabric materials, for instance, can have a basis weight of from about 2 osy to about 5 osy, such as from about 2 osy to about 4 osy, such as from about 2.5 osy to about 3.8 osy.

The present disclosure may be better understood with reference to the following examples.

EXAMPLES

Various different fabric samples were treated with a water resistant treatment in accordance with the present disclosure and tested for their respective properties.

The following fabrics were tested:

- A style 90640 PBI MAX 6.0 osy fabric made of 60% Para-aramid/40% PBI (one yard samples)
- A style 90604 Armor AP Gold fabric made of 60% Para-aramid/40% meta-aramid (one yard samples)
- A style 90609 Armor AP fabric made of 60% Para-aramid/40% meta-aramid (one yard samples)
- A style 90575 PBI MAX Gold 7.0 osy fabric made of 60% Para-aramid/40% PBI (one yard samples)
- A style W5818 ARMOR AP 6.5 osy Forest made of 65% Para-aramid/35% Meta-Aramid (one yard samples)
- A style 90587 PBI MAX 6.0 osy Navy fabric made of 60% Para-aramid/40% PBI (one yard samples)
- A style 90576 PBI MAX 6.0 osy Gold fabric made of 60% Para-aramid/40% PBI (one yard samples)

All laundry cycles performed in Examples 1-5 are in accordance with NFPA 1971, 8-1.2.

Example 1

As observed in Table 2, the fabric samples (Style 90640 and Style 90604) were tested for their spray properties and absorbency properties after being heat treated with the water resistant treatment on a tenter frame and then subjected to fifty (50) laundry cycles. Next, the fabric samples were treated with the water resistant treatment of Table 1 in a garment extractor, more particularly a UniMac industrial extractor. The dwell time of the fabric samples was thirty (30) minutes at a temperature of about 65.5° C. The fabric samples were then directly loaded into a garment drying device, more particularly a tumble-dryer. The fabric samples were not rinsed after being separated from the water resistant treatment in the garment extractor and were directly loaded into the tumble dryer. The fabric samples were dried in the tumble-dryer for thirty (30) minutes at a temperature of about 88° C. allowing the water resistant composition to cure. After the water resistant composition was cured, the fabric samples were tested for their spray properties, absorbency properties, and pH. The results of this testing may be observed in Table 3, which demonstrates that the fabric samples had unexpectedly exceptional pH values without the traditional rinsing step. The fabric samples then underwent five laundry cycles and were tested again for their spray properties and absorbency properties. The results of this testing may be observed in Table 4. All spray test rating values and absorbency values disclosed in Tables 2-4 were measured according to Spray Test AATCC TM22-2017 and according to NFPA 1971-2018, 8.25 respectively.

The formulation of the water resistant treatment is displayed in Table 1.

TABLE 1

Water Resistant Treatment

| Component | Formulation [wt. %] |
|---|---|
| Water (Solvent) | 93.5 |
| Acrylic Polymer and Paraffin Wax Dispersion (Repelling Agent) | 5.0 |
| Blocked Isocyanate (Cross-linking Agent) | 1.0 |
| Isopropyl Alcohol (Wetting Agent) | 0.5 |

TABLE 2

| Fabric | Spray Test Rating | Absorbency [%] |
|---|---|---|
| Style 90640 | 70 | 4.71 |
| Style 90604 | 70 | 5.06 |

TABLE 3

| Fabric | Spray Test Rating | Absorbency [%] | pH |
|---|---|---|---|
| Style 90640 | 100 | 1.87 | 5.86 |
| Style 90604 | 100 | 1.05 | 6.57 |

TABLE 4

| Fabric | Number of Laundry Cycles | Spray Test Rating | Absorbency [%] |
|---|---|---|---|
| Style 90640 | 5x | 100 | 1.14 |
| Style 90604 | 5x | 100 | 1.76 |

Example 2

As observed in Table 6, the fabric samples (Style 90575 and Style 90609) were tested for their spray properties and absorbency properties after being subjected to fifty (50) laundry cycles. Fabric samples of Style 90575 and Style 90609 were untreated. In this respect, fabric samples Style 90575 and Style 90609 were not treated with the water resistant treatment before undergoing the fifty (50) laundry cycles. As displayed in Table 6, the spray rating of these fabric samples was 0 after being subjected to fifty (50) laundry cycles and before being treated in the garment extractor. Then, the fabric samples were treated with the water resistant treatment of Table 5 in a garment extractor, more particularly a UniMac industrial extractor. The dwell time of the fabric samples was thirty (30) minutes at a temperature of about 65.5° C. The fabric samples were then directly loaded into a garment drying device, more particularly a tumble-dryer. The fabric samples were not rinsed after being separated from the water resistant treatment in the garment extractor and were directly loaded into the tumble dryer. The fabric samples were dried in the tumble-dryer for thirty (30) minutes at temperatures of about 60° C. and about 71° C. allowing the water resistant composition to cure. After the water resistant composition was cured, the fabric samples were tested for their spray properties and absorbency properties. The results of this testing may be observed in Table 7. The fabric samples then underwent twenty-five laundry cycles and were tested again for their spray properties and absorbency properties. The results of this testing may be observed in Table 8. All spray test rating values and absorbency values disclosed in Tables 6-8 were measured according to Spray Test AATCC TM22-2017 and according to NFPA 1971-2018, 8.25 respectively.

The formulation of the water resistant treatment is displayed in Table 5.

TABLE 5

| Water Resistant Treatment | |
|---|---|
| Component | Formulation [wt. %] |
| Water (Solvent) | 91.5 |
| Acrylic Polymer and Paraffin Wax Dispersion (Repelling Agent) | 7 |
| Blocked Isocyanate (Cross-linking Agent) | 1 |
| Isopropyl Alcohol (Wetting Agent) | 0.5 |

TABLE 6

| Fabric | Spray Test Rating | Absorbency [%] |
|---|---|---|
| Style 90609 | 0 | 34.68 |
| Style 90575 | 0 | 41.71 |

TABLE 7

| Fabric | Drying Temperature [° C.] | Spray Test Rating | Absorbency [%] |
|---|---|---|---|
| Style 90609 | 60 | 100 | 5.61 |
| Style 90609 | 71 | 100 | 1.25 |
| Style 90575 | 60 | 100 | 0.68 |
| Style 90575 | 71 | 100 | 1.30 |

TABLE 8

| Fabric | Number of Laundry Cycles | Drying Temperature [° C.] | Spray Test Rating | Absorbency [%] |
|---|---|---|---|---|
| Style 90609 | 25x | 60 | 70-80 | 5.65 |
| Style 90609 | 25x | 71 | 80 | 2.07 |
| Style 90575 | 25x | 60 | 80 | 2.91 |
| Style 90575 | 25x | 71 | 80 | 1.87 |

Example 3

As observed in Table 9, the fabric samples (Style 90575 and Style 90609) were tested for their spray properties and absorbency properties after being subjected to fifty (50) laundry cycles. Fabric samples of Style 90575 and Style 90609 were untreated. In this respect, fabric samples Style 90575 and Style 90609 were not treated with the water resistant treatment before undergoing the fifty (50) laundry cycles. As displayed in Table 9, the spray rating of these fabric samples was 0 after being subjected to fifty (50) laundry cycles and before being treated in the garment extractor. As observed in Table 9, the fabric samples (Style 90575 and Style 90609) were treated with the water resistant treatment of Table 1 in a garment extractor, more particularly a UniMac industrial extractor. The dwell time of the fabric samples was thirty (30) minutes at a temperature of about 48° C. to about 52° C. The fabric samples were then directly loaded into a garment drying device, more particularly a tumble-dryer. The fabric samples were not rinsed after being separated from the water resistant treatment in the garment extractor and were directly loaded into the tumble dryer. The fabric samples were dried in the tumble-dryer for thirty (30) minutes at a temperature of about 88° C. allowing the water resistant composition to cure. After the water resistant composition was cured, the fabric samples were tested for their wet weight, dry weight, spray properties, and absorbency properties. Notably, the wet weight, dry weight, and absorbency properties were measured from three different portions of the same sample. The results of this testing may be observed in Table 9. The fabric samples then underwent fifteen laundry cycles and were tested again for their wet weight, dry weight, spray properties, and absorbency properties. The results of this testing may be observed in Table 9. All spray test rating values and absorbency values disclosed in Table 9 were measured according to Spray Test AATCC TM22-2017 and according to NFPA 1971-2018, 8.25 respectively.

TABLE 9

| Fabric | Number of Laundry Cycles | Wet Weight [g] | Dry Weight [g] | Absorbency [%] | Average Absorbency [%] | Spray Test Rating |
|---|---|---|---|---|---|---|
| Style 90575 | 0x | 2.89 | 2.89 | 0.00 | 0.46 | 90-100 |
| | | 2.83 | 2.82 | 0.35 | | |
| | | 2.95 | 2.92 | 1.03 | | |
| | 15x | 2.99 | 2.90 | 3.10 | 3.19 | 80-90 |
| | | 3.06 | 2.98 | 2.68 | | |
| | | 3.03 | 2.92 | 3.77 | | |
| Style 90609 | 0x | 2.85 | 2.78 | 2.52 | 2.38 | 90-100 |
| | | 2.86 | 2.79 | 2.51 | | |
| | | 2.89 | 2.83 | 2.12 | | |
| | 15x | 2.95 | 2.77 | 6.50 | 5.91 | 70-80 |
| | | 2.95 | 2.78 | 6.12 | | |
| | | 2.88 | 2.74 | 5.11 | | |

Example 4

Fabric samples (Style 90575, Style W5818, and Style 90587) were tested for their absorbency properties after being treated with the water resistant treatment displayed in Table 5. The fabric samples were untreated before being treated with the water resistant treatment. The fabric samples (Style 90575, Style W5818, and Style 90587) were treated with the water resistant treatment of Table 5 in a garment extractor, more particularly a UniMac industrial extractor. The dwell time of the fabric samples was thirty (30) minutes at a temperature of about 48° C. to about 52° C. The fabric samples were then directly loaded into a garment drying device, more particularly a tumble-dryer. The fabric samples were not rinsed after being separated from the water resistant treatment in the garment extractor and were directly loaded into the tumble dryer. The fabric samples were dried in the tumble-dryer for thirty (30) minutes at a temperature of about 60° C., about 89° C., and less than about 40° C. respectively, allowing the water resistant composition to cure. After the water resistant composition was cured, the fabric samples were tested for their absorbency properties. Notably, the absorbency properties were measured from three different portions of the same sample. The results of this testing may be observed in Table 10. All absorbency values disclosed in Table 10 were measured according to NFPA 1971-2018, 8.25.

TABLE 10

| | | Style 90575 | | Style W5818 | | Style 90587 | |
|---|---|---|---|---|---|---|---|
| | | Absorption [%] | Average [%] | Absorption [%] | Average [%] | Absorption [%] | Average [%] |
| Drying Conditions | 89° C. | 0.33 | 0.34 | 1.12 | 1.45 | 0.39 | 0.91 |
| | | 0.00 | | 0.35 | | 1.96 | |
| | | 0.67 | | 2.90 | | 0.40 | |
| | 60° C. | 0.00 | 0.46 | 0.00 | 0.50 | 0.00 | 0.26 |
| | | 1.37 | | 0.75 | | 0.79 | |
| | | 0.00 | | 0.74 | | 0.00 | |
| | Less than 40° C. | 1.37 | 6.55 | 5.09 | 6.33 | — | — |
| | | 8.28 | | 10.58 | | — | |
| | | 10.00 | | 3.32 | | — | |

Example 5

As observed in Table 12, fabric samples (Style 90587 and 90576) were tested for their absorbency properties after being subjected to 5× and 10× laundry cycles. Fabric samples of Style 90587 and 90576 were untreated before being treated with the water resistant treatment. Notably, the spray rating of these fabric samples was 0 before being treated in the garment extractor. As observed in Table 12, the fabric samples (Style 90587 and 90576) were treated with the water resistant treatment of Table 11 in a garment extractor, more particularly a UniMac industrial extractor. The dwell time of the fabric samples was thirty (30) minutes at a temperature of about 48° C. to about 52° C. The fabric samples were then directly loaded into a garment drying device, more particularly a tumble-dryer. The fabric samples were not rinsed after being separated from the water resistant treatment in the garment extractor and were directly loaded into the tumble dryer. The fabric samples were dried in the tumble-dryer for thirty (30) minutes at a temperature of about 88° C. allowing the water resistant composition to cure. After the water resistant composition was cured, the fabric samples were tested for their wet weight, dry weight, and absorbency properties. Notably, the wet weight, dry weight, and absorbency properties were measured from three different portions of the same sample. The results of this testing may be observed in Table 12. The fabric samples then underwent five laundry cycles and were tested again for their wet weight, dry weight, and absorbency properties. The results of this testing may be observed in Table 12. The fabric samples then underwent ten laundry cycles and were tested again for their wet weight, dry weight, and absorbency properties. The results of this testing may be observed in Table 12. All absorbency values disclosed in Table 12 were measured according to NFPA 1971-2018, 8.25.

TABLE 11

| Water Resistant Treatment | |
|---|---|
| Component | Formulation [wt. %] |
| Water (Solvent) | 95.8 |
| Acrylic Polymer and Paraffin Wax Dispersion (Repelling Agent) | 3.5 |
| Blocked Isocyanate (Cross-linking Agent) | 0.5 |
| Isopropyl Alcohol (Wetting Agent) | 0.2 |

TABLE 12

| Fabric | Number of Laundry Cycles | Wet Weight [g] | Dry Weight [g] | Absorbency [%] | Average Absorbency [%] |
|---|---|---|---|---|---|
| Style 90587 | 0x | 2.71 | 2.68 | 1.12 | 0.86 |
| | | 2.7 | 2.67 | 1.12 | |
| | | 2.87 | 2.86 | 0.35 | |
| | 5x | 2.59 | 2.57 | 0.78 | 1.53 |
| | | 2.71 | 2.63 | 3.04 | |
| | | 2.64 | 2.62 | 0.76 | |
| | 10x | 2.73 | 2.72 | 0.37 | 0.76 |
| | | 2.64 | 2.61 | 1.15 | |
| Style 90576 | 0x | 2.91 | 2.9 | 0.34 | 0.66 |
| | | 3.17 | 3.13 | 1.28 | |
| | | 2.7 | 2.69 | 0.37 | |
| | 5x | 3.12 | 3.08 | 1.30 | 1.71 |
| | | 2.76 | 2.7 | 2.22 | |
| | | 3.13 | 3.08 | 1.62 | |
| | 10x | 3.09 | 3.02 | 2.32 | 1.12 |
| | | 3.26 | 3.26 | 0.00 | |
| | | 2.92 | 2.89 | 1.04 | |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed:

1. A process for treating a garment comprising fibers, the process comprising:

loading the garment into a garment extractor, the garment extractor being a washing machine;

mixing a solvent with a water resistant concentrate in the garment extractor to form a water resistant treatment, wherein the water resistant concentrate is substantially fluorocarbon free, wherein the water resistant treatment comprises the solvent;

contacting the garment with the water resistant treatment in the garment extractor such that a water resistant composition impregnates the fibers of the garment, the water resistant treatment having a temperature from about 30° C. to about 90° C., the water resistant treatment contacting the garment for a dwell time of about 15 minutes or more;

drying the garment in a garment drying device such that the water resistant composition is cured and affixed to the fibers of the garment; and wherein the garment has a water absorption of less than about 15% according to NFPA 1971-2018, 8.25 after drying the garment in the garment drying device.

2. The process as defined in claim 1, wherein the water resistant treatment and the water resistant concentrate comprise at least one component that is not a component of the water resistant composition.

3. The process as defined in claim 1, wherein the water resistant treatment has an acidic pH.

4. The process as defined in claim 1, wherein the water resistant treatment comprises an acrylic copolymer.

5. The process as defined in claim 1, wherein the water resistant treatment comprises a wax.

6. The process as defined in claim 5, wherein the wax comprises a paraffin wax.

7. The process as defined in claim 1, wherein the water resistant treatment comprises an acrylic copolymer and a paraffin wax.

8. The process as defined in claim 1, wherein the water resistant treatment comprises a dispersion of an acrylic copolymer and a paraffin wax.

9. The process as defined in claim 1, wherein the water resistant treatment comprises one or more cross-linking agents.

10. The process as defined in claim 9, wherein at least one cross-linking agent is a blocked isocyanate.

11. The process as defined in claim 9, wherein the water resistant treatment comprises a dispersion of an acrylic copolymer and a paraffin wax, wherein the ratio of the one or more cross-linking agents to the dispersion of an acrylic copolymer and a paraffin wax is from about 1:10 to about 3:5.

12. The process as defined in claim 1, wherein the water resistant treatment comprises a wetting agent.

13. The process as defined in claim 12, wherein the wetting agent is an evaporable wetting agent.

14. The process as defined in claim 12, wherein the wetting agent is isopropyl alcohol.

15. The process as defined in claim 1, wherein the curing temperature of the water resistant composition is from about 50° C. to about 130° C.

16. The process as defined in claim 1, wherein the garment maintains a water absorption of less than about 15% after five laundry cycles.

17. The process as defined in claim 1, wherein the garment maintains a water absorption of less than about 10% after five laundry cycles.

18. The process as defined in claim 1, wherein the garment maintains a water absorption of less than about 5% after five laundry cycles.

19. The process as defined in claim 1, wherein the garment drying device dries the garment by evaporative drying, centrifugal extraction drying, press drying, vacuum drying, or a combination thereof.

20. The process as defined in claim 1, wherein the garment drying device is a tumble dryer or an oven.

21. The process as defined in claim 20, wherein the oven is a convection oven, an infrared oven, a conduction oven, or a combination thereof.

22. The process as defined in claim 1, wherein the garment is a flame resistant garment for turnout coats for firemen.

23. The process as defined in claim 1, wherein the garment comprises woven fabric made from at least 75% by weight flame resistant fibers.

24. The process as defined in claim 23, wherein the flame resistant fibers comprise PBI fibers, PBO fibers, or mixtures thereof.

25. The process as defined in claim 23, wherein the flame resistant fibers comprise FR cellulose fibers.

26. The process as defined in claim 1, wherein the solvent is present in the water resistant treatment in an amount from about 50% to about 99.9% by weight of the water resistant treatment.

27. The process as defined in claim 1, wherein the solvent is liquid carbon dioxide.

28. The process as defined in claim 1, wherein the water resistant treatment comprises the solvent in an amount of about 80 wt. % or more and the water resistant concentrate comprises a repelling agent in an amount greater than about 30 wt. %.

29. The process as defined in claim 28, wherein the water resistant treatment comprises fluorine, the fluorine being present in the water resistant treatment in an amount less than about 500 ppm.

* * * * *